US011164521B2

(12) United States Patent
Yamamoto

(10) Patent No.: US 11,164,521 B2
(45) Date of Patent: Nov. 2, 2021

(54) PIXEL CIRCUIT AND DISPLAY DEVICE

(71) Applicant: JOLED INC., Tokyo (JP)

(72) Inventor: Tetsuro Yamamoto, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/004,824

(22) Filed: Aug. 27, 2020

(65) Prior Publication Data

US 2021/0125555 A1 Apr. 29, 2021

(30) Foreign Application Priority Data

Oct. 28, 2019 (JP) ..... JP2019-194935

(51) Int. Cl.
*G09G 3/3233* (2016.01)
*G09G 3/20* (2006.01)

(52) U.S. Cl.
CPC ..... *G09G 3/3233* (2013.01); *G09G 3/2003* (2013.01); *G09G 2300/0819* (2013.01); *G09G 2320/0233* (2013.01); *G09G 2330/02* (2013.01)

(58) Field of Classification Search
CPC ..... G09G 3/3233; G09G 3/2003; G09G 2320/0233; G09G 2300/0819; G09G 2330/02
See application file for complete search history.

(56) References Cited

U.S. PATENT DOCUMENTS 6,366,025 B1 * 4/2002 Yamada ..... H01L 27/3246 313/498
2009/0045751 A1 * 2/2009 Peng ..... G09G 3/3233 315/169.2
2009/0153448 A1 6/2009 Tomida et al.
2014/0354704 A1 * 12/2014 Pak ..... G09G 3/3291 345/690
2015/0048335 A1 * 2/2015 Chung ..... H01L 51/5206 257/40
2015/0076456 A1 * 3/2015 Choi ..... H01L 27/3267 257/40

(Continued)

FOREIGN PATENT DOCUMENTS

JP 2009-145594 A 7/2009
JP 2013-057947 A 3/2013
JP 2017-151300 A 8/2017

*Primary Examiner* — Jeff Piziali
(74) *Attorney, Agent, or Firm* — Greenblum & Bernstein, P.L.C.

(57) ABSTRACT

A pixel circuit includes: a driver transistor that supplies a current dependent on a voltage supplied via a signal line; a write transistor connected between the signal line and a gate electrode of the driver transistor; a first organic EL element connected to one electrode of the driver transistor, the one electrode being one of a drain electrode and a source electrode of the driver transistor; a switching transistor connected to the one electrode of the driver transistor; and a second organic EL element connected to the one electrode of the driver transistor via the switching transistor. The pixel circuit performs mobility correction that corrects a mobility of the driver transistor. The switching transistor turns ON after a write operation that writes the voltage supplied via the signal line and turns OFF before an operation that performs the mobility correction of the driver transistor begins.

10 Claims, 20 Drawing Sheets

(56) References Cited

U.S. PATENT DOCUMENTS

| | | | | |
|---|---|---|---|---|
| 2015/0145906 | A1* | 5/2015 | Uetake | G09G 3/207 345/694 |
| 2015/0243217 | A1* | 8/2015 | Park | G09G 3/3233 345/76 |
| 2016/0307983 | A1* | 10/2016 | Wu | H01L 27/3216 |
| 2017/0124956 | A1* | 5/2017 | Yin | G09G 3/3225 |
| 2017/0249901 | A1 | 8/2017 | Nakamura | |
| 2018/0174524 | A1* | 6/2018 | Lee | H01L 51/5218 |
| 2018/0357961 | A1* | 12/2018 | Yang | G09G 3/3266 |
| 2019/0103060 | A1* | 4/2019 | Kang | H01L 27/3216 |

* cited by examiner

PIXEL CIRCUIT AND DISPLAY DEVICE

CROSS REFERENCE TO RELATED APPLICATION

The present application is based on and claims priority of Japanese Patent Application No. 2019-194935 filed on Oct. 28, 2019. The entire disclosure of the above-identified application, including the specification, drawings and claims is incorporated herein by reference in its entirety.

FIELD

The present disclosure relates to a pixel circuit that includes an organic electroluminescent (EL) element, and a display device.

BACKGROUND

One example of known electro-optic elements used in emissive display devices is organic EL elements. Organic EL elements are electro-optic elements that make use of the phenomenon that light is emitted when an electrical field is applied to an organic thin film, and color gradation is achieved by controlling the value of the current flowing through the organic EL element. Accordingly, in organic EL display devices that use organic EL elements, each pixel is provided with a pixel circuit including a driver transistor for controlling the amount of current flowing through the organic EL element, and a storage capacitor that stores the control voltage of the driver transistor.

Variations in characteristics between driver transistors affect the luminance of the light emitted by the organic EL elements. Specific examples of variations in characteristics between driver transistors include variations in threshold voltage and variations in mobility. In view of this, Patent Literature (PTL) 1 discloses a display device that performs threshold voltage correction, which corrects variations in threshold voltage between driver transistors, and mobility correction, which corrects variations in mobility between driver transistors.

CITATION LIST

Patent Literature

PTL 1: Japanese Unexamined Patent Application Publication No. 2013-057947

SUMMARY

Technical Problem

Recent years have seen larger display devices and display devices with higher aperture ratios. Increasing the size or aperture ratio of a display device also increases the surface area of the organic EL elements included in the pixel circuits. This consequently increases the capacitance of the organic EL element. An increase in the capacitance of the organic EL element results in an increase in the time required to correct mobility. Accordingly, the display device according to PTL 1 has a technical problem in that the time required to correct mobility increases when the size or aperture ratio of the display device is increased.

The present disclosure was conceived in view of this problem, and has an object to provide a pixel circuit and a display device that increases the speed of mobility correction.

Solution to Problem

In order to achieve the above-described object, a pixel circuit according to one aspect of the present disclosure includes: a driver transistor configured to supply a current dependent on a voltage supplied via a signal line; a write transistor connected between the signal line and a gate electrode of the driver transistor; a first light emitting element connected to one electrode of the driver transistor, the one electrode being one of a drain electrode and a source electrode of the driver transistor; a switching transistor connected to the one electrode of the driver transistor; and a second light emitting element connected to the one electrode of the driver transistor via the switching transistor. The pixel circuit is configured to perform mobility correction that corrects a mobility of the driver transistor, and the switching transistor is configured to turn ON after a write operation that writes the voltage supplied via the signal line and turn OFF before an operation that performs the mobility correction of the driver transistor begins.

In order to achieve the above-described object, a display device according to one aspect of the present disclosure includes: the pixel circuit described above; a horizontal selector configured to apply the voltage to the signal line; a write scanner configured to control the write transistor; a power supply scanner configured to apply a potential to the source electrode or the drain electrode of the driver transistor; and a switch scanner configured to control the switching transistor.

Advantageous Effects

According to one aspect of the present disclosure, the pixel circuit, etc., can increase the speed of mobility correction.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENT

Underlying Knowledge Forming Basis of the Present Disclosure

Before describing each of the embodiments according to the present disclosure, the underlying knowledge forming the basis of the present disclosure will be described.

Figure 1:
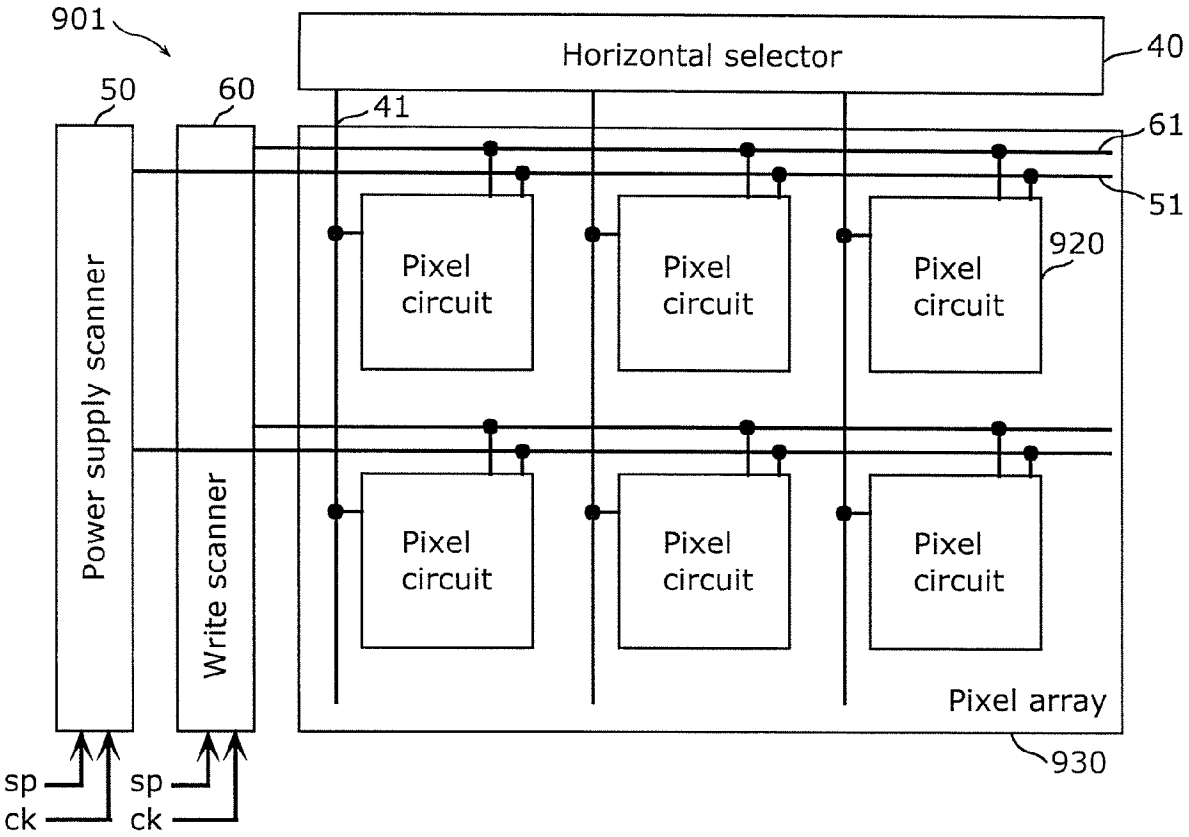
FIG. 1 PRIOR ART
FIG. 1 illustrates a schematic configuration of a conventional organic EL display device.

First, a schematic configuration of a conventional organic EL display device will be described with reference to FIG. 1. FIG. 1 illustrates a schematic configuration of a conventional organic EL display device 901.

As illustrated in FIG. 1, organic EL display device 901 on which the present disclosure is premised includes pixel array 930, horizontal selector 40, power supply scanner 50, and write scanner 60. Pixel array 930 is comprised of pixel circuits 920 arranged in a two-dimensional matrix. Each pixel circuit 920 includes an organic EL element. Horizontal selector 40, power supply scanner 50, and write scanner 60 collectively form a drive circuit unit (drive unit) disposed in the vicinity of pixel array 930.

When conventional organic EL display device 901 supports color display, one pixel (unit pixel), which corresponds to a unit of information that makes up a color image, is comprised of a plurality of subpixel circuits. Each of these subpixel circuits corresponds to pixel circuit 920 illustrated in FIG. 1. More specifically, in organic EL display device 901, which supports color display, one pixel is comprised of, for example, three subpixel circuits, namely a first subpixel circuit that emits blue (B) light, a second subpixel circuit that emits red (R) light, and a third subpixel circuit that emits green (G) light. Blue light is one example of first color light, red light is one example of light of second color light, and green light is one example of third color light.

However, one pixel is not limited to a combination of three subpixel circuits corresponding to the RGB colors; one pixel may additionally include one or more subpixel circuits corresponding to one or more colors. For example, one pixel may additionally include a subpixel circuit that emits white (W) color for improving luminance, and one pixel may additionally include one or more subpixel circuits that emit complementary color light for a wider color reproduction range.

Moreover, each pixel row in pixel array 930 is provided with power supply line 51 and scan line 61 that extend parallel to the row direction (the direction in which pixel circuits 920 are arranged in a single pixel row) relative to the m rows and n columns of pixels. Moreover, in pixel array 930, each pixel column is provided with signal line 41 that extends parallel to the column direction (the direction in which pixel circuits 920 are arranged in a single pixel column) relative to the m rows and n columns of pixels.

Each signal line 41 is connected to the output terminal of the corresponding pixel column of horizontal selector 40. Each power supply line 51 is connected to the output terminal of the corresponding pixel row of power supply scanner 50. Each scan line 61 is connected to the output terminal of the corresponding pixel row of write scanner 60.

Horizontal selector 40 (signal line drive circuit) selectively outputs signal voltage Vsig (hereinafter also simply referred to as "signal voltage") of an image signal and reference potential Vofs. Signal voltage Vsig is dependent on luminance information supplied from a signal supply source (not illustrated in the drawings). Here, reference potential Vofs is a voltage that serves as a reference for signal voltage Vsig of an image signal (for example, a voltage corresponding to a black level of an image signal), and is used when performing a threshold correction operation, which will be described later.

Signal voltage Vsig and reference potential Vofs output from horizontal selector 40 are written to pixel circuits 920 in pixel array 930 via signal line 41 on a row-by-row basis for pixel rows selected via scanning by write scanner 60. In other words, horizontal selector 40 employs a line sequential writing driving mode in which signal voltage Vsig is written on a row-by-row (line-by-line) basis.

Power supply scanner 50 (power supply scan circuit) is configured of, for example, a shift register circuit that sequentially shifts start pulses sp in synchronization with clock pulse ck. Power supply scanner 50 switches between supplying first potential Vcc and supplying second potential Vss, which is lower than first potential Vcc, to power supply line 51, in synchronization with the line sequential scanning by write scanner 60. As will be described later, this switching between first potential Vcc and second potential Vss (switching between power supply potentials) controls the light emission and non-emission states of pixel circuits 920.

Write scanner 60 (write scan circuit) is configured of, for example, a shift register circuit that sequentially shifts (transfers) start pulses sp in synchronization with clock pulse ck. When writing a signal voltage of an image signal to each pixel circuit 920 of pixel array 930, write scanner 60 sequentially supplies write scan signals (which are write voltages; hereinafter also referred to as ON signals) to scan lines 61, thereby scanning (line sequential scanning) pixel circuits 920 of pixel array 930 in succession on a row-by-row basis.

Figure 2:
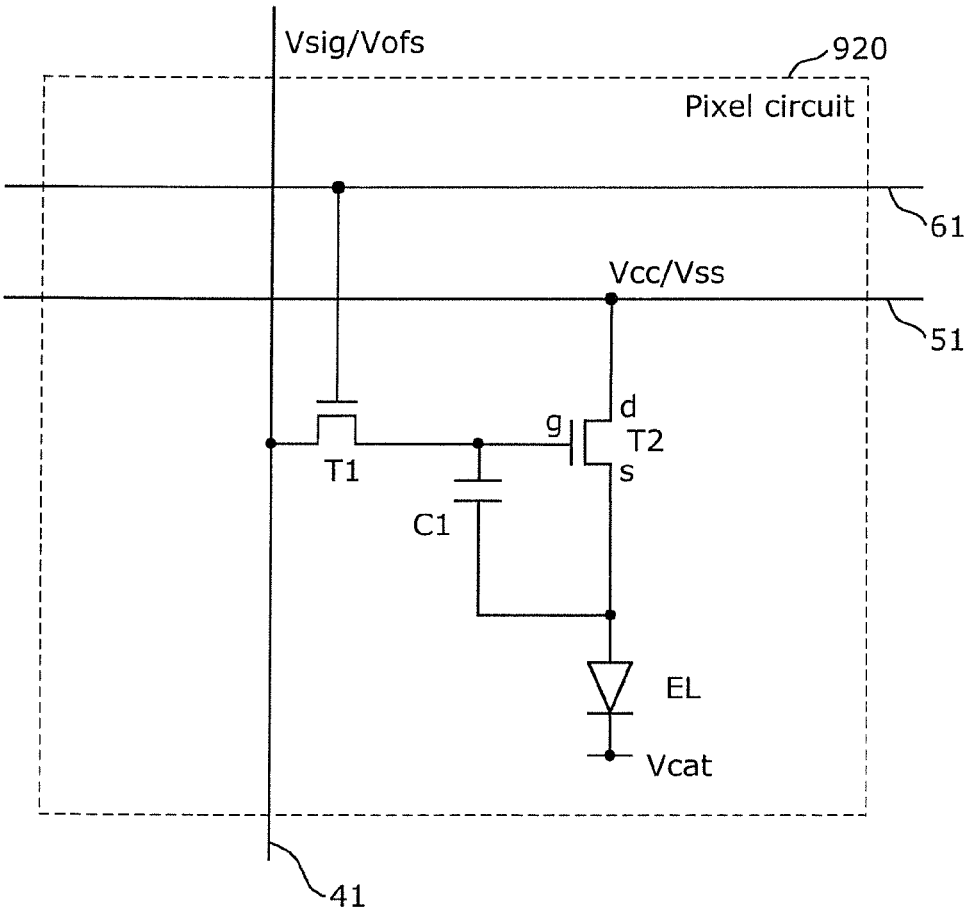
FIG. 2 PRIOR ART
FIG. 2 illustrates a circuit diagram of a conventional pixel circuit.

Next, pixel circuits 920 included in organic EL display device 901 configured as described above will be described with reference to FIG. 2. FIG. 2 illustrates a circuit diagram of a conventional pixel circuit 920.

As illustrated in FIG. 2, pixel circuit 920 is a circuit that causes organic EL element EL to emit light at a luminance that corresponds to the image signal, and includes organic EL element EL, storage capacitor C1, write transistor T1, and driver transistor T2. Pixel circuit 920 may further include, for example, a reference transistor and an initialization transistor. The reference transistor is a thin film transistor for applying a reference voltage to storage capacitor C1, and the initialization transistor is a thin film transistor for initializing the potential of a first electrode of organic EL element EL.

Organic EL element EL is a light emitting element including a first electrode and a second electrode. In the example illustrated in FIG. 2, the first electrode and the second electrode are respectively the anode and the cathode of organic EL element EL. The second electrode of organic EL element EL is connected to a cathode power supply line. The cathode power supply line is supplied with cathode potential Vcat. Organic EL element EL is one example of the light emitting element. The cathode power supply line is wired commonly to all pixel circuits 920.

Storage capacitor C1 is an element for storing voltage, and is connected between gate electrode g and source electrode s of driver transistor T2.

Write transistor T1 is a thin film transistor for applying voltage that corresponds to the image signal to storage capacitor C1. Signal line 41 is connected to one of the drain electrode and the source electrode of write transistor T1, and storage capacitor C1 and gate electrode g of driver transistor T2 are connected to the other of the drain electrode and the source electrode of write transistor T1. Scan line 61 is connected to the gate electrode of write transistor T1. For example, write transistor T1 enters an ON state in accordance with an ON signal, and stores voltage corresponding to the image signal in storage capacitor C1.

Driver transistor T2 is an N-channel thin film transistor that is connected to the first electrode (anode) of organic EL element EL and supplies current dependent on the voltage stored in storage capacitor C1 to organic EL element EL. Source electrode s of driver transistor T2 is connected to the first electrode of organic EL element EL, and drain electrode d is connected to power supply line 51. First potential Vcc or second potential Vss is selectively supplied to power supply line 51 from power supply scanner 50.

For example, N-channel thin film transistors (TFT) can be used as write transistor T1 and driver transistor T2, but the conductivity types of write transistor T1 and driver transistor T2 are not limited to this combination example.

Moreover, depending on the relationship between the potential of the first electrode of organic EL element EL and the potential supplied from power supply line 51, the positional relationship of source electrode s and drain electrode d in driver transistor T2 can be changed from the relationship illustrated in FIG. 2.

In pixel circuit 920 configured as described above, write transistor T1 enters a conducting state (ON state) in accordance with an ON signal applied to the gate electrode from write scanner 60 via scan line 61. With this, write transistor T1 samples and writes, into pixel circuit 920, signal voltage Vsig or reference potential Vofs supplied from horizontal selector 40 via signal line 41. Signal voltage Vsig or reference potential Vofs written by write transistor T1 is applied to gate electrode g of driver transistor T2 and stored in storage capacitor C1.

When the power supply potential from power supply line 51 is first potential Vcc, the power supply line 51 side becomes drain electrode d and the organic EL element EL side becomes source electrode s, whereby driver transistor T2 operates in a saturation region, as illustrated in FIG. 2. With this, driver transistor T2 receives a supply of current from power supply line 51 and drives organic EL element EL so as to emit light via current driving. More specifically, as a result of driver transistor T2 operating in a saturation region, driver transistor T2 supplies a drive current, whose current value is dependent on the voltage value of signal voltage Vsig stored in storage capacitor C1, to organic EL element EL, and causes organic EL element EL to emit light by current driving organic EL element EL.

Furthermore, when the power supply potential from power supply line 51 is switched from first potential Vcc to second potential Vss, the power supply line 51 side becomes source electrode s and the organic EL element EL side becomes drain electrode d, whereby driver transistor T2 operates as a switching transistor. With this, driver transistor T2 interrupts the supply of drive current to organic EL element EL, thereby placing organic EL element EL in a light non-emission state. In other words, driver transistor T2 can function as a transistor that controls the light emission and non-emission states of organic EL element EL.

By providing a period in which organic EL element EL is in a light non-emission state (hereinafter also referred to as a non-emission period) via this switching operation performed by driver transistor T2, it is possible to control the duty of the emission period and the non-emission period of organic EL element EL. This duty control makes it possible to reduce the afterimage effect resulting from pixel circuits 920 emitting light across a period of one frame, which in turn makes it possible to improve video quality.

Among first potential Vcc and second potential Vss that are selectively supplied from power supply scanner 50 via power supply line 51, first potential Vcc is a power supply potential for supplying, to driver transistor T2, drive current that drives organic EL element EL so as to emit light, and second potential Vss is a power supply potential for applying a negative bias (reverse bias) to organic EL element EL. Second potential Vss is set lower than reference potential Vofs. For example, when the threshold voltage of driver transistor T2 is set to Vth, second potential Vss is set lower than Vofs−Vth.

Figure 3:
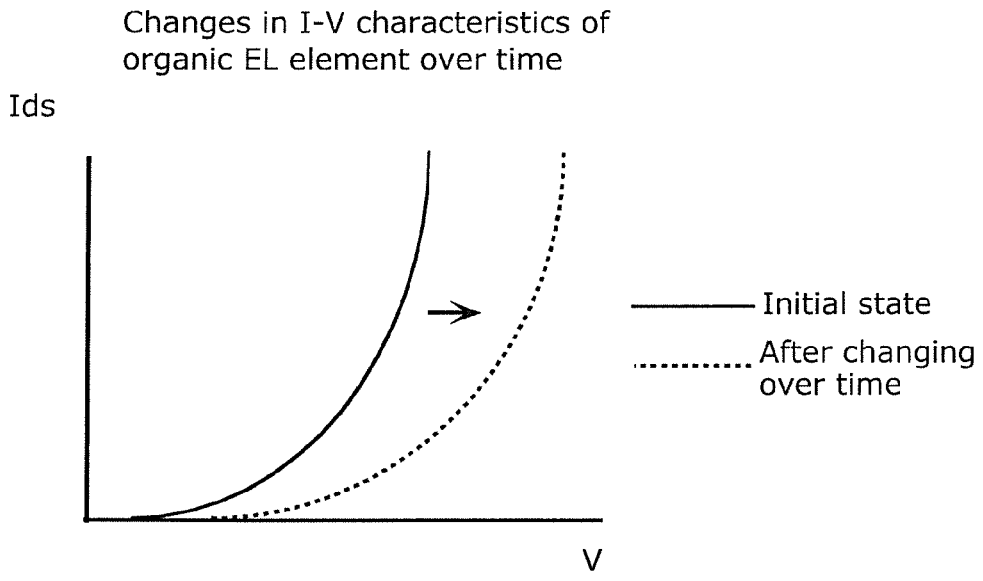
FIG. 3 illustrates changes in the I-V characteristics of an organic EL element over time.

Next, changes in the I-V characteristics (current-voltage characteristics) of organic EL element EL over time will be described with reference to FIG. 3. FIG. 3 illustrates changes in the I-V characteristics of organic EL element EL over time.

As illustrated in FIG. 3, the I-V characteristics of organic EL element EL change over time from the I-V characteristics indicated by the solid line to the I-V characteristics indicated by the dotted line. Drain-source current Ids is expressed as $Ids=1/2\times\mu\times W/L\times C(Vgs-Vth)^2$ (Expression 1), where Vth is the threshold voltage, p is the mobility, W is the effective channel width (effective gate width), L is the effective channel length (effective gate length), C is the gate capacitance per unit area, and Vgs is the gate-source voltage of driver transistor T2. Note that drain-source current Ids of driver transistor T2 approximately corresponds to the drive current of organic EL element EL. Hereinafter, for convenience, an example in which drain-source current Ids corresponds to the drive current of organic EL element EL will be given. Moreover, the drive current is also referred to as drive current Ids.

At this time, in pixel circuit 920 illustrated in FIG. 2, even if driver transistor T2 attempts to pass a constant drive current Ids, since applied voltage V of organic EL element EL increases, as shown by the graph illustrated in FIG. 3, the potential of the first electrode (anode) of organic EL element EL (that is, source potential Vs of driver transistor T2) increases. At this time, since the gate of driver transistor T2 is in a floating state, the source potential and the gate potential both increase and drive current Ids is maintained at an approximately constant value, so as to maintain gate-source voltage Vgs at an approximately constant value. This works to prevent the luminance of organic EL element EL from changing.

However, since threshold voltage Vth and mobility μ of driver transistor T2 vary from pixel circuit 920 to pixel circuit 920, this results in variations in current values according to Expression 1, whereby the luminance varies from pixel circuit 920 to pixel circuit 920. Accordingly, in pixel circuit 920 which includes driver transistor T2, correction operations for correcting threshold voltage Vth and mobility μ are required for reducing variations in threshold voltage Vth and mobility μ. These correction operations will be described later.

Figure 4:
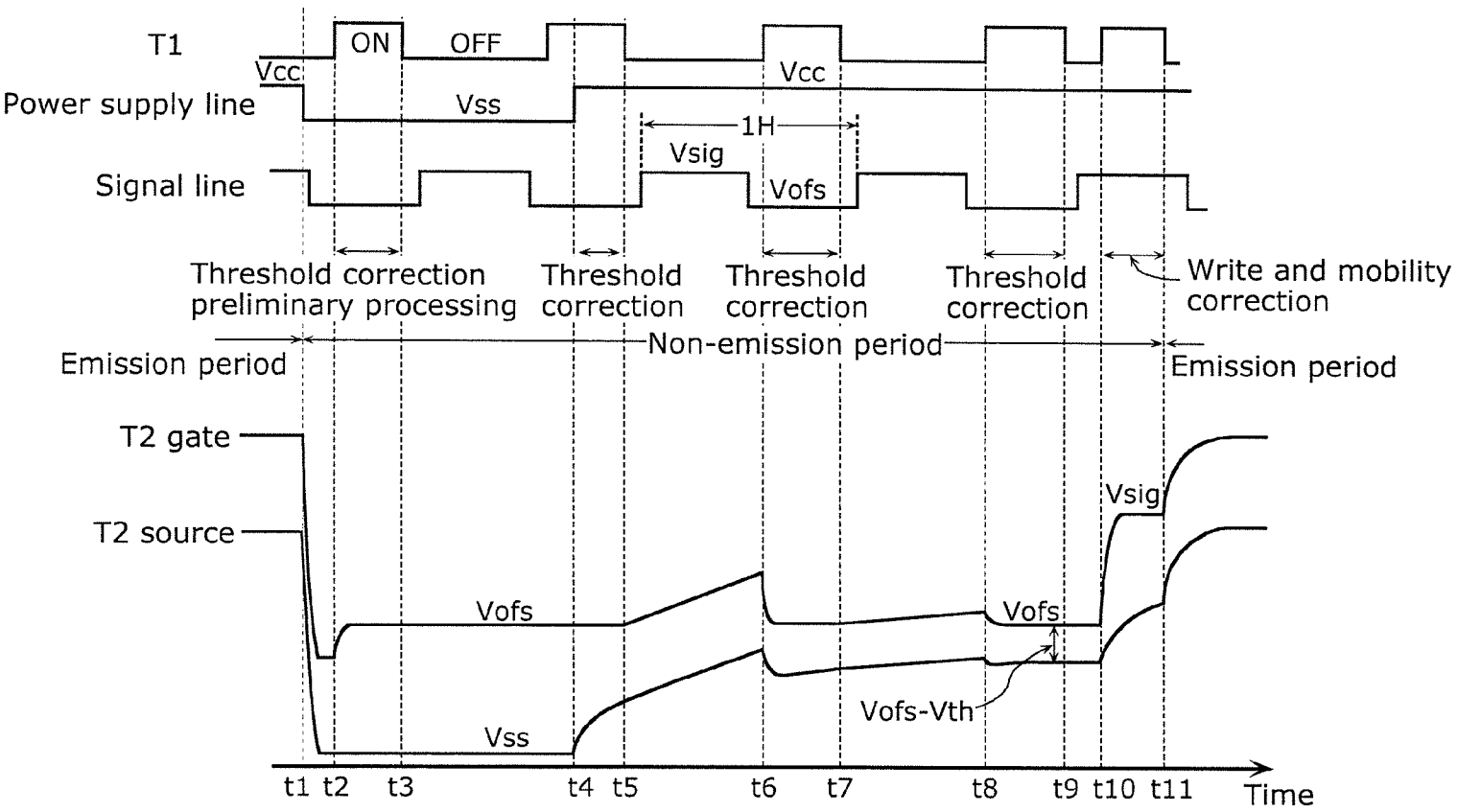
FIG. 4 PRIOR ART
FIG. 4 is a timing chart for describing circuit operations performed by the conventional organic EL display device.

Next, circuit operations performed by organic EL display device 901 described above will be described with reference to FIG. 4 through FIG. 14. FIG. 4 is a timing chart for describing circuit operations performed by the conventional organic EL display device 901. FIG. 4 illustrates changes in the potential of the gate electrode of write transistor T1 (i.e., the potential of scan line 61; either a high potential (ON) or low potential (OFF)), the potential (Vcc or Vss) of power supply line 51, the potential (Vsig or Vofs) of signal line 41, the potential of gate electrode g of driver transistor T2 ("T2 gate" in FIG. 4), and the potential of source electrodes of driver transistor T2 ("T2 source" in FIG. 4).

Emission Period of Previous Display Frame

In the timing chart illustrated in FIG. 4, the period before time t1 is the emission period of organic EL element EL in the previous display frame. In the emission period of the previous display frame, the potential of power supply line 51 is first potential Vcc (hereinafter also referred to as high potential Vcc), and write transistor T1 is in a non-conducting state (OFF state).

Figure 5:
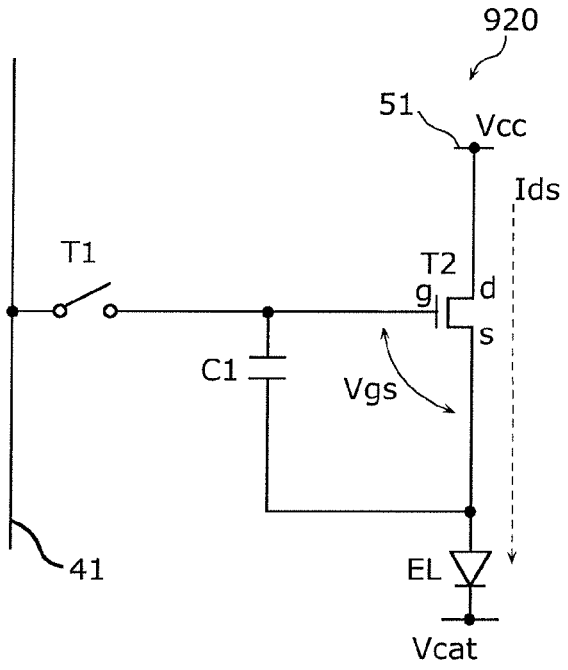
FIG. 5 PRIOR ART
FIG. 5 is a first figure for describing circuit operations performed by the conventional organic EL display device.

At this time, driver transistor T2 is set so as to operate in the saturation region. Consequently, as illustrated in FIG. 5, drive current Ids (drain-source current) dependent on gate-source voltage Vgs of driver transistor T2 is supplied from power supply line 51 to organic EL element EL via driver transistor T2. Accordingly, organic EL element EL emits light of a luminance that is in accordance with the current value of drive current Ids. Note that FIG. 5 is a first figure for describing circuit operations performed by the conventional organic EL display device 901. Moreover, drive current Ids flowing through organic EL element EL at this time takes a value that is dependent on gate-source voltage Vgs of driver transistor T2 and is calculated by Expression 1.

Non-Emission Period

Figure 6:
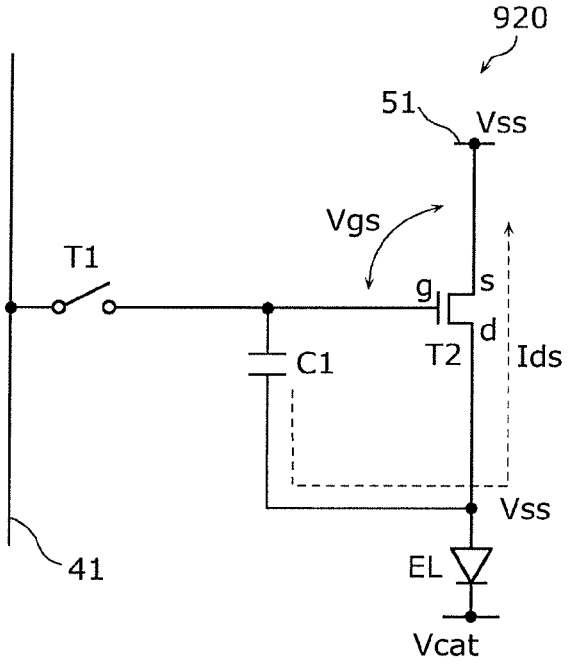
FIG. 6 PRIOR ART
FIG. 6 is a second figure for describing circuit operations performed by the conventional organic EL display device.

At time t1, the line sequential scanning enters a new display frame (current display frame). Then, as illustrated in FIG. 6, the potential of power supply line 51 switches from high potential Vcc to second potential Vss (hereinafter also referred to as low potential Vss). Relative to reference potential Vofs of signal line 41, low potential Vss is a potential that is sufficiently lower than Vofs−Vth, and is capable of causing organic EL element EL to not emit light. Note that FIG. 6 is a second figure for describing circuit operations performed by the conventional organic EL display device 901.

Here, when low potential Vss satisfies Vss<Vthel+Vcat (Expression 2), where Vthel is the threshold voltage and Vcat is the cathode potential of organic EL element EL, since source potential Vs of driver transistor T2 is approximately equal to low potential Vss, organic EL element EL enters a reverse bias state, and stops emitting light. Then, the power supply line 51 side of driver transistor T2 becomes source electrode s. At this time, the first electrode (anode) of organic EL element EL is charged by Vss.

Threshold Correction Preliminary Period

Figure 7:
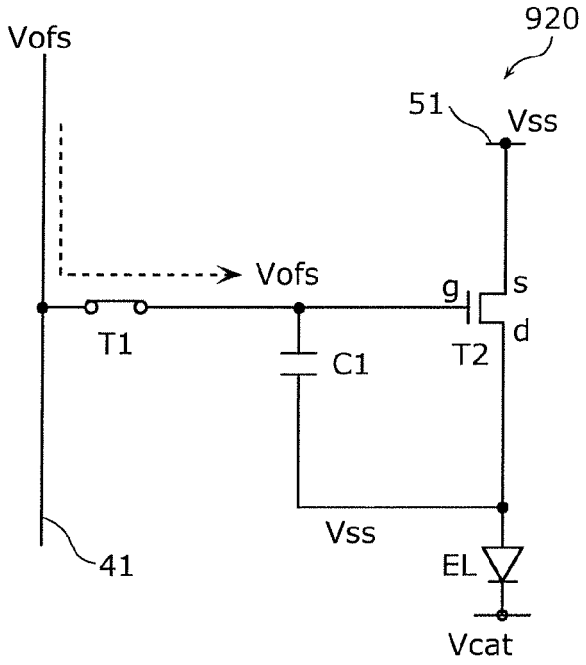
FIG. 7 PRIOR ART
FIG. 7 is a third figure for describing circuit operations performed by the conventional organic EL display device.

Next, the potential of scan line 61 transitioning from the low potential side to the high potential side (i.e., from OFF to ON) at time t2 places write transistor T1 in a conducting state, as illustrated in FIG. 7. Note that FIG. 7 is a third figure for describing circuit operations performed by the conventional organic EL display device 901.

At this time, since reference potential Vofs is supplied from horizontal selector 40 to signal line 41, gate potential Vg of driver transistor T2 becomes reference potential Vofs. Moreover, source potential Vs of driver transistor T2 is a potential that is sufficiently lower than reference potential Vofs, that is to say, is low potential Vss.

At this time, gate-source voltage Vgs of driver transistor T2 is Vofs−Vss. Here, if Vofs−Vss is not greater than threshold voltage Vth of driver transistor T2, the threshold correction operation (to be described later) cannot be performed, so it is necessary to set Vofs−Vss so as to satisfy the potential relation Vofs−Vss>Vth (Expression 3).

In this way, initialization processing that fixes gate potential Vg of driver transistor T2 to reference potential Vofs and fixes source potential Vs to low potential Vss is preliminary processing performed before threshold correction operation (to be described later) (i.e., is threshold correction preliminary processing). Accordingly, reference potential Vofs and low potential Vss are the initialization potentials of gate potential Vg and source potential Vs of driver transistor T2, respectively.

The potential of scan line 61 transitioning from the high potential side to the low potential side (i.e., from ON to OFF) at time t3 ends the threshold correction preliminary period. The period from time t2 to time t3 is a threshold correction preliminary period.

Threshold Correction Period

Figure 8:
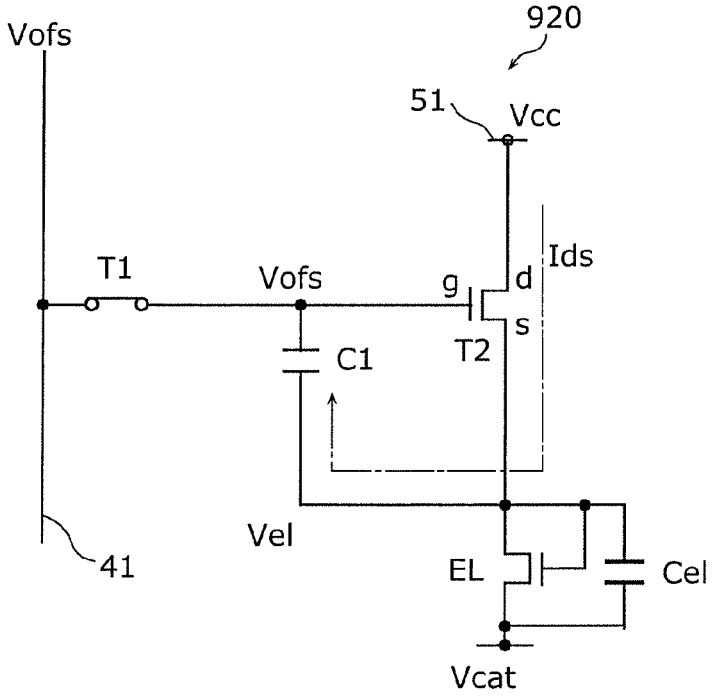
FIG. 8 PRIOR ART
FIG. 8 is a fourth figure for describing circuit operations performed by the conventional organic EL display device.

Next, at time t4, when the potential of power supply line 51 switches from low potential Vss to high potential Vcc while write transistor T1 is in a conducting state, the first electrode of organic EL element EL becomes the source electrode s of driver transistor T2, as illustrated in FIG. 8, and current flows to driver transistor T2. Consequently, the threshold correction operation starts in a state in which gate potential Vg of driver transistor T2 is maintained at reference potential Vofs. In other words, source potential Vs of driver transistor T2 begins to increase from gate potential Vg toward a potential calculated by subtracting threshold voltage Vth of driver transistor T2 (i.e., Vofs−Vth). Note that FIG. 8 is a fourth figure for describing circuit operations performed by the conventional organic EL display device 901.

Here, for convenience, using reference potential Vofs (i.e., the initialization voltage) of gate potential Vg of driver transistor T2 as a reference, the operation (process) for causing source potential Vs to change from reference potential Vofs toward a voltage calculated by subtracting threshold voltage Vth of driver transistor T2, will be referred to as a threshold correction operation (threshold correction processing). As this threshold correction operation progresses, in time, gate-source voltage Vgs of driver transistor T2 converges to threshold voltage Vth of driver transistor T2. A voltage corresponding to this threshold voltage Vth is stored in storage capacitor C1.

Note that in the periods in which a threshold correction operation is performed (the threshold correction periods in FIG. 4), in order to cause current to flow to the storage capacitor C1 side and not to flow to the organic EL element EL side, cathode potential Vcat of the power supply cathode power supply line is set so as to place organic EL element EL in a cut-off state (high-impedance state).

An equivalent circuit of organic EL element EL is expressed as a diode and equivalent capacitor Cel, as illustrated in FIG. 8. So long as the relation Vel≤Vcat+Vthel (Expression 4) holds true, where Vel is the source potential of driver transistor T2, the current of driver transistor T2 is used for charging storage capacitor C1 and equivalent capacitor Cel. For example, so long as the leak current of organic EL element EL is substantially smaller than the current flowing through driver transistor T2, the current of driver transistor T2 is used for charging storage capacitor C1 and equivalent capacitor Cel. Note that source potential Vel is also the potential of the first electrode of organic EL element EL.

Figure 9:
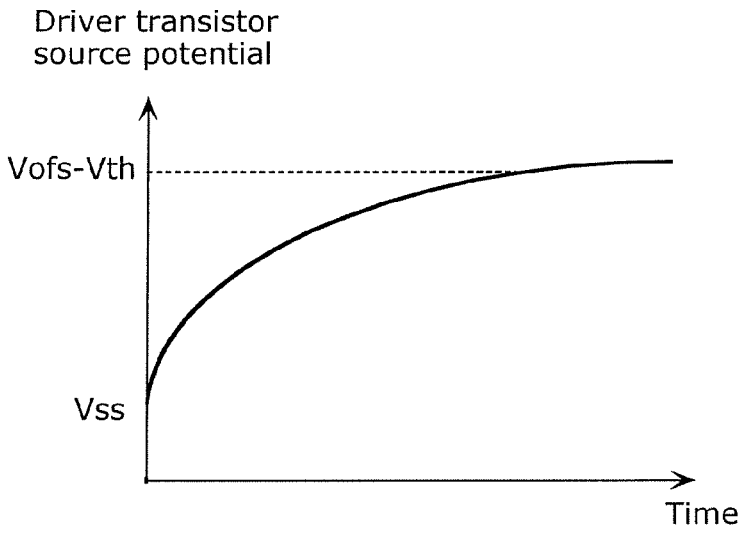
FIG. 9 PRIOR ART
FIG. 9 is a first figure illustrating changes in source potential of the driver transistor in the conventional organic EL display device.

Next, changes in source potential Vel will be described with reference to FIG. 9. FIG. 9 is a first figure illustrating changes in source potential Vel of driver transistor T2 in the conventional organic EL display device 901. FIG. 9 schematically illustrates changes in source potential Vel under a threshold correction operation.

As illustrated in FIG. 9, source potential Vel increases over time. Source potential Vel gradually increases from Vss toward Vofs−Vth.

Figure 10:
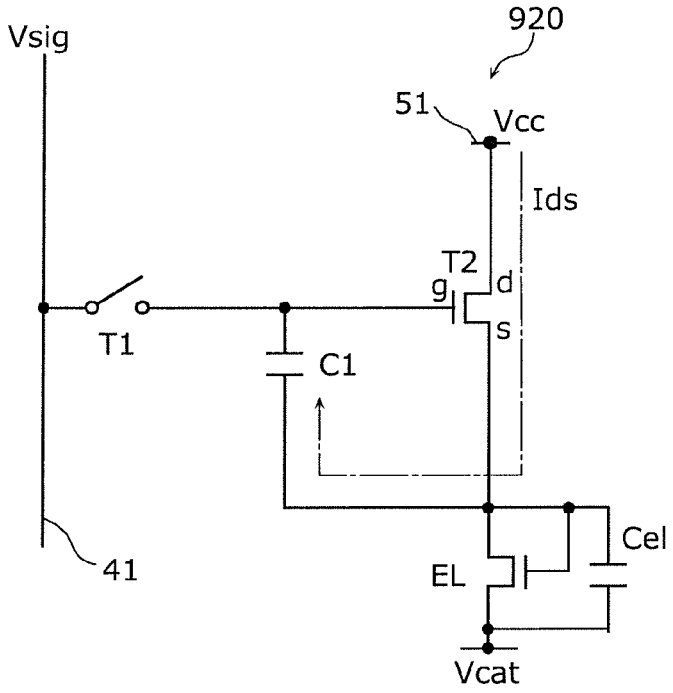
FIG. 10 PRIOR ART
FIG. 10 is a fifth figure for describing circuit operations performed by the conventional organic EL display device.

Next, at time t5, the potential of scan line 61 transitioning to the low potential side (i.e., from ON to OFF) places write transistor T1 in a non-conducting state. Write transistor T1 enters a non-conducting state at time t5, which is a point in time after elapse of a first period after time t4. At this time, gate electrode g of driver transistor T2 is in a floating state as a result of electrically disconnecting from signal line 41. However, since gate-source voltage Vgs is greater than threshold voltage Vth of driver transistor T2, current (drain-source current Ids) flows, and the gate and source potentials of driver transistor T2 increase, as illustrated in FIG. 10. Note that since a reverse bias is applied to organic EL element EL at this time, organic EL element EL does not emit light. Note that FIG. 10 is a fifth figure for describing circuit operations performed by the conventional organic EL display device 901.

Next, at time t6, in the period in which the potential of signal line 41 is reference potential Vofs (for example, at the point in time the potential of signal line 41 becomes reference potential Vofs), write transistor T1 is placed in a conducting state whereby a threshold correction operation is started once again. By repeating this operation, the value of gate-source voltage Vgs of driver transistor T2 eventually becomes threshold voltage Vth. Here, source potential Vel of driver transistor T2 is expressed as Vel=Vofs−Vth≤Vcat+Vthel (Expression 5).

Next, at time t7, the potential of scan line 61 transitioning to the low potential side (i.e., from ON to OFF) places write transistor T1 in a non-conducting state. Write transistor T1 enters a non-conducting state at time t7, which is a point in time after elapse of a second period after time t6.

Moreover, the threshold correction operation is repeated in the period between time t8 and time t9 as well. Time t9 is the time at which the threshold correction operation ends, and write transistor T1 enters a non-conducting state at time t9. The period from time t4 to time t5, the period from time t6 to time t7, and the period from time t8 to time t9 are threshold correction periods.

In this way, in addition to the 1H period in which organic EL display device 901 performs the threshold correction operation along with the write operation and the mobility correction operation, organic EL display device 901 may perform the threshold correction operation multiple times divided across a plurality of horizontal periods ahead of the 1H period, that is to say, perform a "divided threshold correction operation".

With this divided threshold correction operation, even if the time allotted as a single horizontal period is short due to an increase in the number of pixels to achieve a higher definition, sufficient time can be ensured across a plurality of horizontal periods functioning as the threshold correction period. Accordingly, since a sufficient amount of time for a threshold correction period can be ensured even if the time allotted to a single horizontal period is short, it is possible to perform the threshold correction operation with certainty. Note that the number of times the threshold correction operation is performed is not limited to the above example; for example, the threshold correction operation may be performed only one time.

Write and Mobility Correction Period

Figure 11:
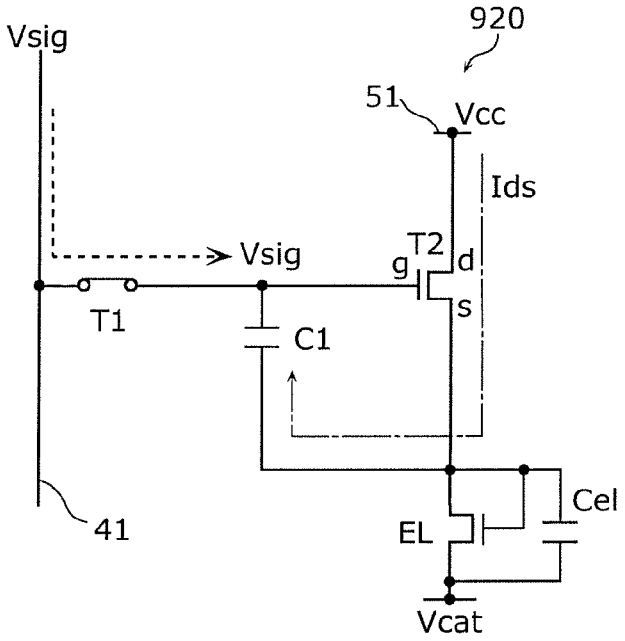
FIG. 11 PRIOR ART
FIG. 11 is a sixth figure for describing circuit operations performed by the conventional organic EL display device.

Next, at time t10, in a state in which the potential of signal line 41 has switched from reference potential Vofs to signal voltage Vsig of the image signal, the potential of scan line 61 transitioning to the high potential side (i.e., from OFF to ON) places write transistor T1 in a conducting state, whereby signal voltage Vsig of the image signal is sampled and written in pixel circuit 920, as illustrated in FIG. 11. Note that FIG. 11 is a sixth figure for describing circuit operations performed by the conventional organic EL display device 901. Moreover, signal voltage Vsig is a voltage dependent on the gradation of the image signal.

The writing of signal voltage Vsig by write transistor T1 turns gate potential Vg of driver transistor T2 into signal voltage Vsig. At this time, organic EL element EL is in a cut-off state. Accordingly, depending on signal voltage Vsig of the image signal, the current flowing through driver transistor T2 (drain-source current Ids) from power supply line 51 flows into storage capacitor C1 and equivalent capacitor Cel. This starts the charging of storage capacitor C1 and equivalent capacitor Cel.

For example, if source potential Vs of driver transistor T2 does not exceed the sum of threshold voltage Vthel and cathode potential Vcat of organic EL element EL, the current for driver transistor T2 is used for charging storage capacitor C1 and equivalent capacitor Cel.

The charging of equivalent capacitor Cel of organic EL element EL causes source potential Vs of driver transistor T2 to increase over time. At this time, variations in threshold voltage Vth of driver transistor T2 between pixel circuits 920 are already cancelled by the threshold correction operation, and drain-source current Ids of driver transistor T2 is dependent on mobility μ of driver transistor T2 (see Expression 1). With this, reflecting mobility μ, the value of gate-source voltage Vgs of driver transistor T2 decreases, and after elapse of a given period of time, becomes a value that completely corrects mobility μ. Note that mobility μ of driver transistor T2 is the mobility of the semiconductor thin film that forms the channel of driver transistor T2.

Figure 12:
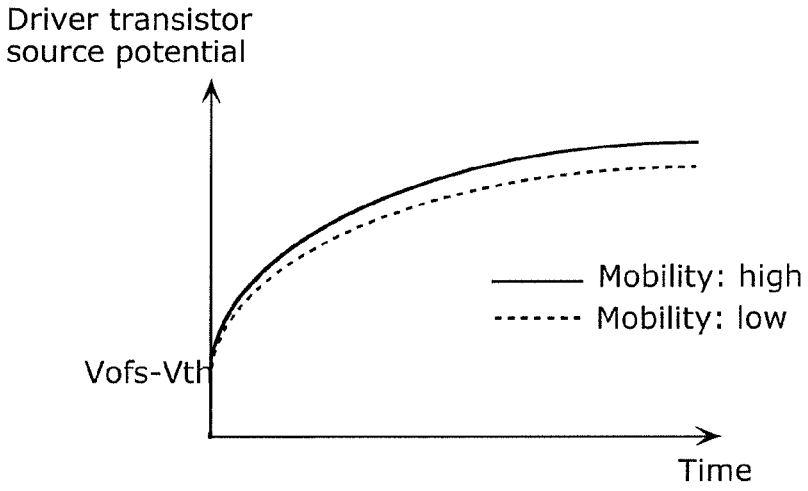
FIG. 12 PRIOR ART
FIG. 12 is a second figure illustrating the relation between source potential of the driver transistor and mobility in the conventional organic EL display device.

FIG. 12 is a second figure illustrating a relationship between source potential Vs of driver transistor T2 and mobility μ in the conventional organic EL display device 901. FIG. 12 illustrates changes in source potential caused by variations in mobility μ.

As illustrated in FIG. 12, in pixel circuit 920 that includes driver transistor T2 having a relatively high mobility μ, the amount of current of driver transistor T2 is high, and source potential Vs increases faster than when mobility μ is relatively low. Moreover, in pixel circuit 920 that includes driver transistor T2 having a relatively low mobility μ, the amount of current of driver transistor T2 is low, and source potential Vs increases slower than when mobility μ is relatively high.

For example, consider a case in which, in two pixel circuits 920 whose mobilities μ are different, signal voltage Vsig of the same level is applied to gate electrodes g of driver transistors T2. In this case, if mobility correction is not performed, there will be a significant difference in the values of drain-source current Ids flowing through pixel circuit 920 having a high mobility μ and drain-source current Ids flowing through pixel circuit 920 having a low mobility μ. Consequently, due to the differences in mobilities μ between the two pixel circuits 920, there is a significant difference in the values of drain-source current Ids, which results in a loss of uniformity in the image (for example, a loss of brightness uniformity).

For this reason, mobility correction is performed as described above. Hereinafter, mobility correction will be described in greater detail.

When the ratio of the stored voltage of storage capacitor C1 to signal voltage Vsig of the image signal, i.e., the write gain, is assumed to be one (ideal value), source potential Vs of driver transistor T2 increases from Vofs−Vth by an amount of ΔVs, whereby gate-source voltage Vgs of driver transistor T2 becomes Vsig−Vofs+Vth−ΔVs. ΔVs indicates the amount of potential that source potential Vs is increased by.

In other words, the amount of increase ΔVs of source potential Vs of driver transistor T2 works so as to be subtracted from the voltage stored in storage capacitor C1 (Vsig−Vofs+Vth), or stated differently, works so as to discharge the charge of storage capacitor C1. Stated in yet another way, the amount of increase ΔVs of source potential Vs of driver transistor T2 is negative feedback applied to storage capacitor C1. Accordingly, the amount of increase ΔVs of source potential Vs is an amount of negative feedback.

In this way, as a result of negative feedback being applied to gate-source voltage Vgs by an amount of feedback ΔVs dependent on drain-source current Ids flowing through driver transistor T2, the dependency on mobility μ of drain-source current Ids of driver transistor T2 can be cancelled out. This cancelling operation is a mobility correction operation for correcting variations in mobility μ of driver transistor T2 between pixel circuits 920.

More specifically, when correction via feedback ΔVs is applied to pixel circuit 920 having a high mobility μ, drain-source current Ids significantly drops—from a first current value to a second current value. On the other hand, since feedback ΔVs of a pixel circuit 920 having a low mobility μ is low, drain-source current Ids drops from a third current value (which is less than the first current value) to a fourth current value. Performing mobility correction in a period in which the second current value and the fourth current value are equal corrects variations in mobility μ between pixel circuits 920. The amount of negative feedback ΔVs can also be referred to as a correction amount for the mobility correction operation.

Moreover, since the higher the signal amplitude (Vsig−Vofs) of the image signal written to gate electrode g of driver transistor T2 is, the higher the value of drain-source current Ids is, the absolute value of the amount of negative feedback ΔVs also increases. Accordingly, the mobility correction operation is dependent on the luminance level.

Emission Period

Next, at time t11, the potential of scan line 61 transitioning to the low potential side (i.e., from ON to OFF) places write transistor T1 in a non-conducting state, and the write operation ends. Consequently, gate electrode g of driver transistor T2 is in a floating state as a result of electrically disconnecting from signal line 41. The period from time t10 to time t11 is a write and mobility correction period.

Here, when gate electrode g of driver transistor T2 is in a floating state, by storage capacitor C1 being connected between the gate and source of driver transistor T2, gate potential Vg changes in conjunction with changes in source potential Vs of driver transistor T2. In other words, source potential Vs and gate potential Vg of driver transistor T2 increase while gate-source voltage Vgs stored in storage capacitor C1 is maintained. Source potential Vs of driver transistor T2 increases to a light-emission voltage of organic EL element EL that is dependent on drain-source current Ids (saturation current) of driver transistor T2.

In this way, the operation whereby gate potential Vg of driver transistor T2 changes in conjunction with changes in source potential Vs of driver transistor T2 is a bootstrap operation. Stated differently, a bootstrap operation is an operation whereby gate potential Vg and source potential Vs change while gate-source voltage Vgs stored in storage capacitor C1, i.e., voltage across both terminals of storage capacitor C1 is maintained.

Figure 13:
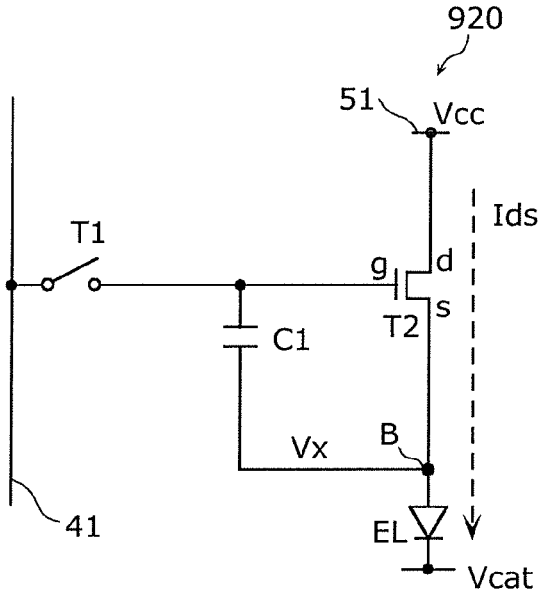
FIG. 13 PRIOR ART
FIG. 13 is a seventh figure for describing circuit operations performed by the conventional organic EL display device.

As a result of gate electrode g of driver transistor T2 entering a floating state and at the same time drain-source current Ids of driver transistor T2 starting to flow through organic EL element EL, the potential of the first electrode (anode) of organic EL element EL increases to potential Vx in accordance with drain-source current Ids, as illustrated in FIG. 13. Then, when potential Vx (for example, the potential at point B in FIG. 13) of the first electrode of organic EL element EL exceeds Vthel+Vcat, drive current Ids begins to flow through organic EL element EL, causing organic EL element EL to start emitting light. Note that FIG. 13 is a seventh figure for describing circuit operations performed by the conventional organic EL display device 901.

In pixel circuit 920 configured as described above, the longer organic EL element EL emits light, the more the I-V characteristics change (degrade), i.e., the I-V characteristics change (degrade) over time. Accordingly, the potential at point B in FIG. 13 also changes. However, since gate-source voltage Vgs of driver transistor T2 is not maintained at a constant value, the current flowing through organic EL element EL does not change. Accordingly, even if the I-V characteristics of organic EL element EL change, a constant drive current Ids continues to flow through organic EL element EL, and thus the luminance of organic EL element EL does not change.

Next, mobility correction operation in signal writing will be discussed. As described above, a mobility correction operation is an operation for increasing source potential Vs of driver transistor T2 for a given period of time, until source potential Vs (gate-source voltage Vgs) reaches a level that corrects variations in mobility μ of driver transistor T2 in each pixel circuit 920, by causing current to flow through driver transistor T2 after completion of the threshold correction operation. At this time, the increase in source potential Vs of driver transistor T2 is dependent on the current flowing through driver transistor T2 and the capacitor connected to source electrode s of driver transistor T2.

Figure 14:
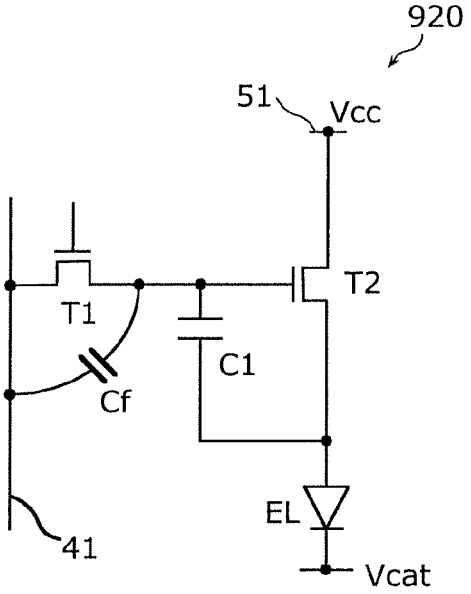
FIG. 14 PRIOR ART
FIG. 14 is an eighth figure for describing circuit operations performed by the conventional organic EL display device.

Typically, emission of light by organic EL display device 901 is determined by the amount of current flowing through organic EL element EL, which is determined by driver transistor T2. It is preferable to reduce the size (W/L ratio) of driver transistor T2 in pixel circuit 920 in order to reduce the effect of coupling noise generated by parasitic capacitance Cf between gate electrode g of driver transistor T2 and the wire disposed adjacent to driver transistor T2 (for example, signal line 41 in the example in FIG. 14). However, reducing the size of driver transistor T2 also reduces the amount of increase in source potential Vs of driver transistor T2 in the mobility correction operation, thereby increasing the time required to perform mobility correction. Note that FIG. 14 is an eighth figure for describing circuit operations performed by the conventional organic EL display device 901.

Moreover, when organic EL display device 901 is large, the size of the pixel circuits (pixels) increases, and the surface area of organic EL elements EL increase. This increases the capacitance of equivalent capacitor Cel of organic EL element EL, which increases the time required to perform mobility correction.

Accordingly, it is difficult to perform mobility correction within a predetermined period of time (for example, a 1H period), and abnormalities such as cut-off lines and uneven regions may appear in the image.

In view of this, as a result of diligent research, the inventor of the present application invented a pixel circuit and an organic EL display device which can increase the speed of mobility correction (mobility correction operation) in an organic EL display device that performs the above-described mobility correction operation. Hereinafter, such a pixel circuit and organic EL display device will be described.

Hereinafter, an exemplary embodiment of the present disclosure will be described with reference to the drawings. The exemplary embodiment described below is merely one specific example of the present disclosure. The numerical values, shapes, materials, elements, and arrangement and connection of the elements, steps, order of the steps, etc., indicated in the following exemplary embodiment are examples, and are not intended to limit the present disclosure. Therefore, among elements in the following exemplary embodiment, those not recited in any one of the independent claims in the present disclosure are described as optional elements.

Note that the respective figures are schematic diagrams and are not necessarily precise illustrations. Additionally, like reference signs indicate like elements. As such, repeated explanations of like elements are omitted or simplified.

Moreover, in the present specification, terminology expressing a relationship between elements, such as "equal", stated values, and value ranges include essentially equivalent values or value ranges, i.e., include deviations of, for example, about a few percent. Moreover, the terminology "constant" used in the present specification includes a range of values that would be considered essentially constant, i.e., includes deviations of, for example, about a few percent.

Embodiment

1. Organic EL Display Device Configuration

Figure 15:
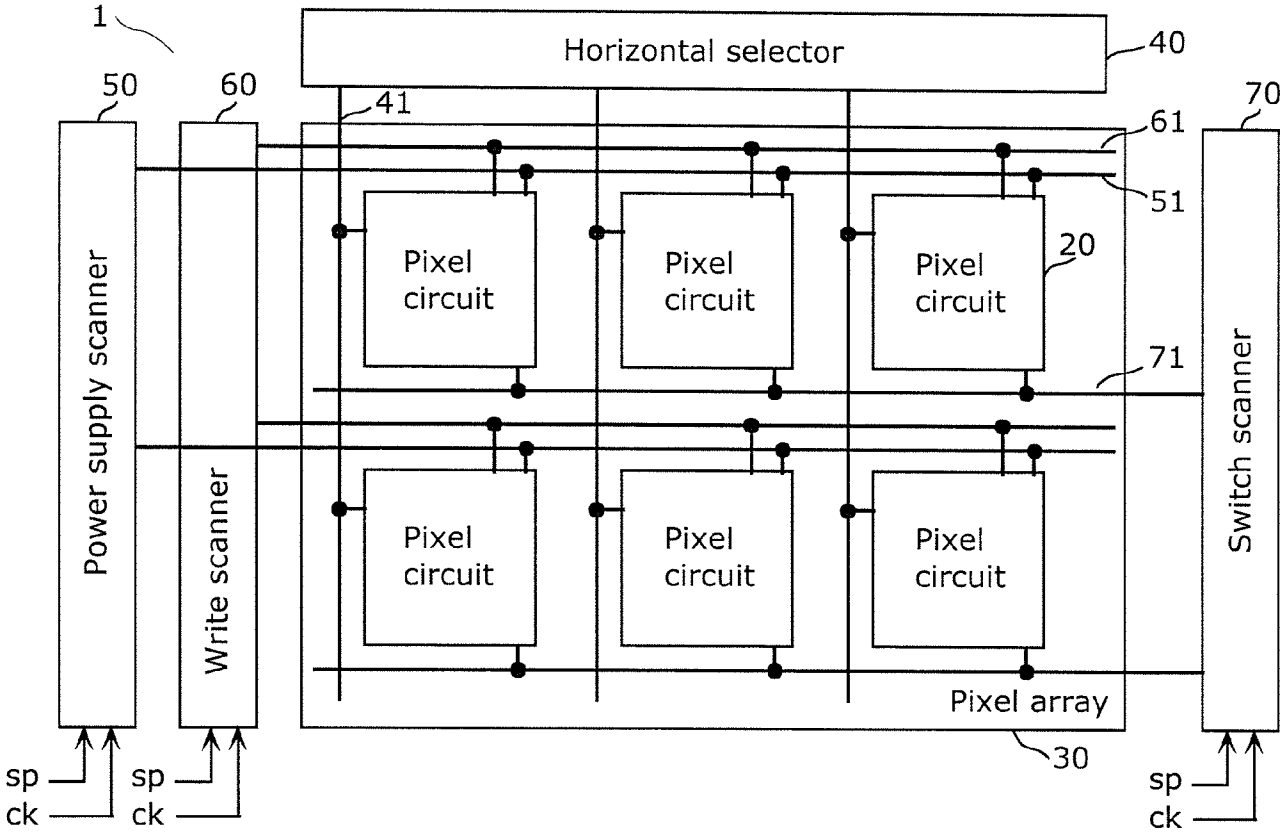
FIG. 15 illustrates a schematic configuration of an organic EL display device according to an embodiment.

First, a schematic configuration of organic EL display device 1 according to the present embodiment will be described with reference to FIG. 15. FIG. 15 illustrates a schematic configuration of organic EL display device 1 according to the present embodiment. Pixel circuit 20 included in organic EL display device 1 according to the present embodiment mainly differs from the conventional pixel circuit 920 in that a single pixel circuit 20 includes two organic EL elements (first organic EL element EL1 and second organic EL element EL2 illustrated in FIG. 16) and a switching transistor (switching transistor T3 illustrated in FIG. 16), and that one organic EL element is connected to driver transistor T2 via switching transistor T3. The following description of pixel circuit 20 and organic EL display device 1 according to the present embodiment will focus on the points of difference from the conventional pixel circuit 920 and organic EL display device 901. Moreover, elements that are the same or similar as those in the conventional organic EL display device 901 share the same reference signs as those in the conventional organic EL display device 901. As such, repeated explanations of like elements are omitted or simplified. Note that organic EL display device 1 is one example of the display device.

As illustrated in FIG. 15, organic EL display device 1 according to the present embodiment includes pixel array 30, horizontal selector 40, power supply scanner 50, write scanner 60, and switch scanner 70. Pixel array 30 is comprised of pixel circuits (pixels) 20 arranged in a two-dimensional matrix. Each pixel circuit 20 includes organic EL elements. Horizontal selector 40, power supply scanner 50, write scanner 60, and switch scanner 70 collectively form a drive circuit unit (drive unit) disposed in the vicinity of pixel array 30.

Moreover, each pixel row in pixel array 30 is provided with power supply line 51, scan line 61, and control line 71 that extend parallel to the row direction (the direction in which pixel circuits 20 are arranged in a single pixel row) relative to the m rows and n columns of pixel circuits 20 (pixels). Moreover, in pixel array 30, each pixel column is provided with signal line 41 that extends parallel to the column direction (the direction in which pixel circuits 20 are arranged in a single pixel column) relative to the m rows and n columns of pixels.

Each control line 71 is connected to the output terminal of the corresponding pixel row of switch scanner 70. Control lines 71 are connected to the gate electrodes of switching transistors (for example, switching transistor T3 in FIG. 16).

Horizontal selector 40 (signal line drive circuit) selectively outputs signal voltage Vsig (hereinafter also simply referred to as "signal voltage") of an image signal and reference potential Vofs. Signal voltage Vsig is dependent on luminance information supplied from a signal supply source (not illustrated in the drawings).

Signal voltage Vsig and reference potential Vofs output from horizontal selector 40 are written to pixel circuits 20 in pixel array 30 via signal line 41 on a row-by-row basis for pixel rows selected via scanning by write scanner 60. In other words, horizontal selector 40 employs a line sequential writing driving mode in which signal voltage Vsig is written on a row-by-row (line-by-line) basis.

Power supply scanner 50 (power supply scan circuit) is configured of, for example, a shift register circuit that sequentially shifts start pulses sp in synchronization with clock pulse ck. Power supply scanner 50 switches between supplying first potential Vcc and supplying second potential Vss, which is lower than first potential Vcc, to power supply line 51, in synchronization with the line sequential scanning by write scanner 60. As will be described later, this switching between first potential Vcc and second potential Vss (switching between power supply potentials) controls the light emission and non-emission states of pixel circuits 20.

Write scanner 60 (write scan circuit) is configured of, for example, a shift register circuit that sequentially shifts (transfers) start pulses sp in synchronization with clock pulse ck. When writing a signal voltage of an image signal to each pixel circuit 20 of pixel array 30, write scanner 60 sequentially supplies write scan signals (which are write voltages; hereinafter also referred to as ON signals) to scan lines 61, thereby scanning (line sequential scanning) pixel circuits 20 of pixel array 30 in succession on a row-by-row basis.

Switch scanner 70 is configured of, for example, a shift register circuit that sequentially shifts (transfers) start pulses sp in synchronization with clock pulse ck. When writing a signal voltage of an image signal to each pixel circuit 20 of pixel array 30, switch scanner 70 sequentially supplies switch scan signals to control line 71, thereby scanning (line sequential scanning) pixel circuits 20 of pixel array 30 in succession on a row-by-row basis. A switch scan signal is a switch voltage for switching switching transistor T3 illustrated in FIG. 16 between conducting and non-conducting states.

Figure 16:
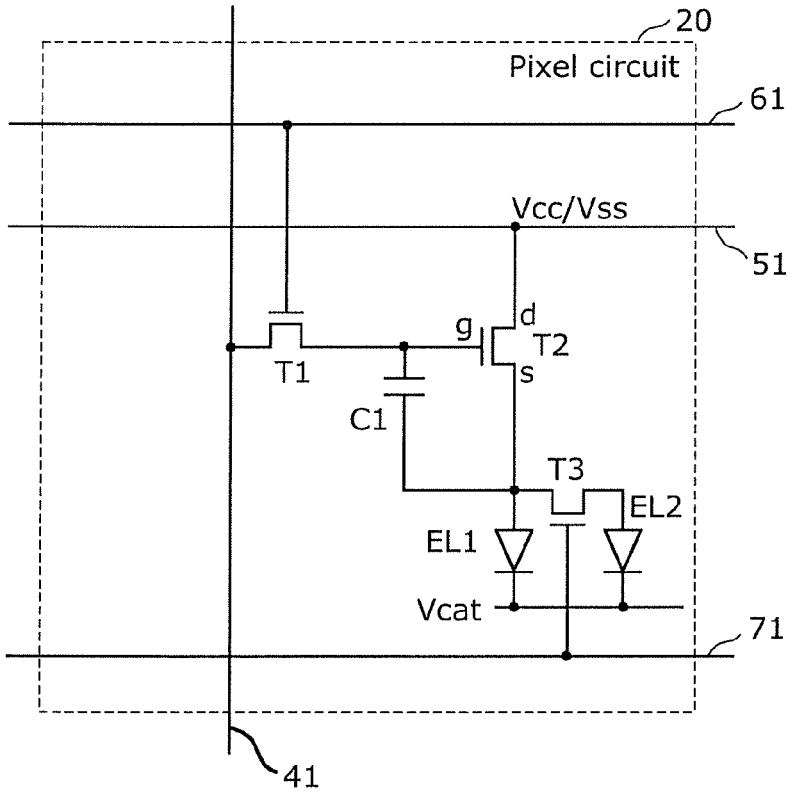
FIG. 16 illustrates a circuit diagram of a pixel circuit according to the embodiment.

Next, pixel circuits 20 included in organic EL display device 1 configured as described above will be described with reference to FIG. 16. FIG. 16 illustrates a circuit diagram of pixel circuit 20 according to the present embodiment.

As illustrated in FIG. 16, pixel circuit 20 includes first organic EL element EL1 second organic EL element EL2, storage capacitor C1, write transistor T1, driver transistor T2, and switching transistor T3. Organic EL display device 1 is characterized by the inclusion of two organic EL elements—namely first organic EL element EL1 and second organic EL element EL2—in a single pixel circuit 20, and the inclusion of switching transistor T3 that is connected to second organic EL element EL2. Pixel circuit 20 may further include, for example, a reference transistor and an initialization transistor. The reference transistor is a thin film transistor for applying a reference voltage to storage capacitor C1, and the initialization transistor is a thin film transistor for initializing the potential of first electrodes of first organic EL element EL1 and second organic EL element EL2.

First organic EL element EL1 is a light emitting element including a first electrode and a second electrode. In the example illustrated in FIG. 16, the first electrode and the second electrode are respectively the anode and the cathode of first organic EL element EL1. First organic EL element EL1 is one example of the first light emitting element.

Second organic EL element EL2 is a light emitting element including a first electrode and a second electrode. In the example illustrated in FIG. 16, the first electrode and the second electrode are respectively the anode and the cathode of second organic EL element EL2. Second organic EL element EL2 is one example of the second light emitting element.

The first electrode of first organic EL element EL1 is connected to source electrode s of driver transistor T2. First organic EL element EL1 is connected to source electrode s of driver transistor T2 without switching transistor T3 being disposed therebetween. For example, first organic EL element EL1 is directly connected to source electrode s of driver transistor T2. The first electrode of second organic EL element EL2 is connected to one of the source electrode and the drain electrode of switching transistor T3. Second organic EL element EL2 is connected to source electrode s of driver transistor T2 via switching transistor T3. Moreover, the second electrodes of first organic EL element EL1 and second organic EL element EL2 are connected to a cathode power supply line. The cathode power supply line is wired commonly to all pixel circuits 20.

Note that the light emitting elements included in pixel circuit 20 are not limited to organic EL elements. The light emitting elements included in pixel circuit 20 may be, for example, quantum-dot light emitting diodes (QLED). In other words, the first light emitting element included in pixel circuit 20 may be a first QLED element, and the second light emitting element included in pixel circuit 20 may be a second QLED element.

Note that hereinafter, when it is not necessary to differentiate between first organic EL element EL1 second organic EL element EL2, either may be simply referred to as an "organic EL element".

Pixel circuit 20 according to the present embodiment can be regarded as having a structure achieved by dividing organic EL element EL included in the conventional pixel circuit 920 into two. Note that the number of organic EL elements included in a single pixel circuit 20 is not limited to 2; a single pixel circuit 20 may include three or more organic EL elements.

Storage capacitor C1 is an element for storing voltage, and is connected between gate electrode g and source electrode s of driver transistor T2.

Write transistor T1 is a thin film transistor for applying voltage that corresponds to the image signal to storage capacitor C1. Write transistor T1 is connected between signal line 41 to which the image signal is applied and gate electrode g of driver transistor T2. More specifically, signal line 41 is connected to one of the drain electrode and the source electrode of write transistor T1, and storage capacitor C1 and gate electrode g of driver transistor T2 are connected to the other of the drain electrode and the source electrode of write transistor T1. Scan line 61 is connected to the gate electrode of write transistor T1. For example, write transistor T1 enters an ON state in accordance with an ON signal, and stores voltage corresponding to the image signal in storage capacitor C1. For example, an N-channel TFT can be used as write transistor T1, but the conductivity type of write transistor T1 is not limited to this example.

Driver transistor T2 is an N-channel thin film transistor that is connected to the first electrode (anode) of first organic EL element EL1 and connected to the first electrode (anode) of second organic EL element EL2 via switching transistor T3, and supplies current dependent on the voltage stored in storage capacitor C1 to first organic EL element EL1 and second organic EL element EL2. One of source electrode s and drain electrode d of driver transistor T2 is connected to the first electrode of first organic EL element EL1 and connected to the first electrode of second organic EL element EL2 via switching transistor T3, and the other of source electrode s and drain electrode d of driver transistor T2 is connected to power supply line 51. In the present embodiment, source electrode s of driver transistor T2 is connected to the first electrode of first organic EL element EL1 and connected to the first electrode of second organic EL element EL2 via switching transistor T3, and drain electrode d of driver transistor T2 is connected to power supply line 51. First potential Vcc and second potential Vss are selectively supplied to power supply line 51 from power supply scanner 50.

Switching transistor T3 is a thin film transistor that is connected to the first electrode (anode) of second organic EL element EL2 and supplies current (for example, current dependent on the voltage stored in storage capacitor C1) from driver transistor T2 to second organic EL element EL2. One of the source electrode and the drain electrode of switching transistor T3 is connected to source electrode s of driver transistor T2, and the other of the source electrode and the drain electrode of switching transistor T3 is connected to the first electrode of second organic EL element EL2. The gate electrode of switching transistor T3 is connected to control line 71. For example, switching transistor T3 enters an ON state in accordance with an ON signal from control line 71, and consequently supplies current from driver transistor T2 to second organic EL element EL2.

Moreover, depending on the relationship between the potential of the first electrodes of first organic EL element EL1 and second organic EL element EL2 and the potential supplied from power supply line 51, the positional relationship of source electrode s and drain electrode d in driver transistor T2 can be changed from the relationship illustrated in FIG. 16. The potential of the first electrodes is, for example, the anode potential.

Figure 17:
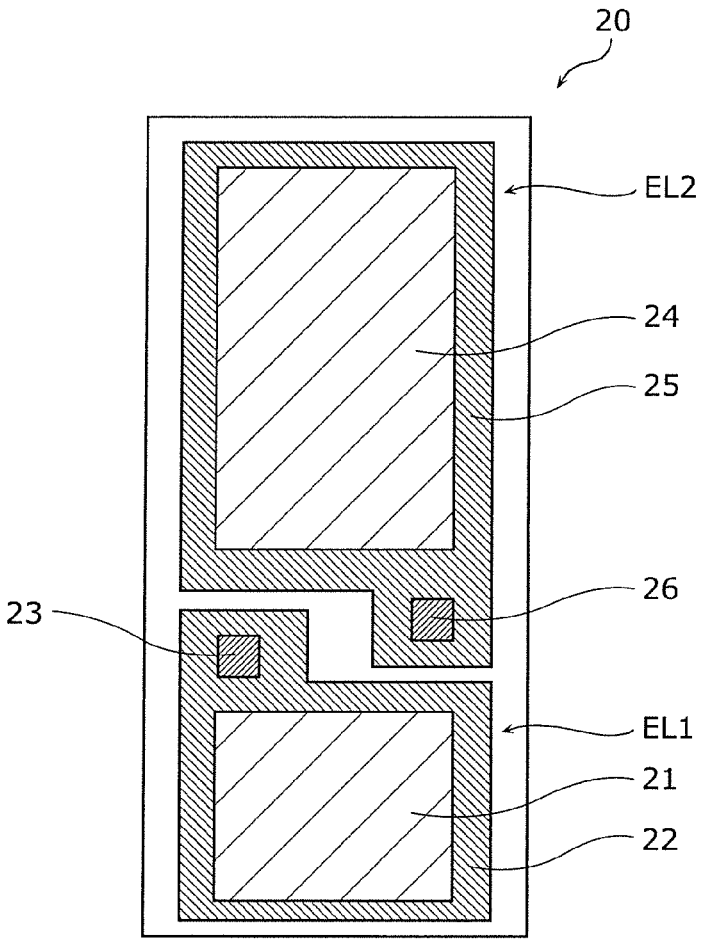
FIG. 17 illustrates a schematic structure of the pixel circuit in a plan view of the organic EL display device according to the embodiment.

Next, the planar structure of pixel circuit 20 including first organic EL element EL1 and second organic EL element EL2 will be described with reference to FIG. 17. FIG. 17 illustrates a schematic structure of pixel circuit 20 in a plan view of organic EL display device 1 according to the present embodiment. Among elements included in pixel circuit 20, FIG. 17 only illustrates the light emitters, the first electrodes (anodes), and the contact parts of first electrodes. Note that a plan view refers to a view in a direction parallel to the optical axis of light emitted from organic EL element.

FIG. 17 illustrates a planar structure of a configuration in which organic EL elements are formed above the substrate of a TFT layer, that is to say, a planar structure of a configuration in which a top-emission structure is used. In pixel circuit 20, light is extracted from the front surface of the substrate. Note that the TFT layer includes a TFT circuit formed on the substrate and an inorganic insulating film (not illustrated) formed on the TFT circuit. The TFT circuit includes a plurality of TFTs formed on the top surface of the substrate, and a plurality of wires. The material used for the gate electrode, gate insulating layer, channel layer, channel protection layer, source electrode, drain electrode, etc., that form the TFT is not particularly limited; known material may be used. Moreover, the TFT layer may include a planarizing film.

As illustrated in FIG. 17, in pixel circuit 20, first organic EL element EL1 and second organic EL element EL2 are aligned. First organic EL element EL1 includes light emitter 21, first electrode 22 (anode), and contact part 23. Second organic EL element EL2 includes light emitter 24, first electrode 25 (anode), and contact part 26.

Light emitters 21 and 24 emit light by organic electroluminescence. For example, light emitters 21 and 24 may be organic light emitting diodes (OLED). Light emitter 21 is one example of the first light emitter, and light emitter 24 is one example of the second light emitter.

The surface area (plan view surface area) of light emitter 24 is preferably larger than the surface area (plan view surface area) of light emitter 21. It can be said that the surface area of second organic EL element EL2 is larger than the surface area of first organic EL element EL1. In other words, the surface area of second organic EL element EL2 that is connected to switching transistor T3 is preferably larger than the surface area of first organic EL element EL1 that is connected to driver transistor T2. Stated differently, the surface area of first organic EL element EL1 is preferably smaller than the surface area of second organic EL element EL2. From the perspective of speeding up mobility correction, the surface area of first organic EL element EL1 is preferably small. For example, the surface area of first organic EL element EL1 is at most half of the surface area of the second organic EL element, and preferably at most a third of the surface area of the second organic EL element.

First electrodes 22 and 25 are electrodes for injecting carriers (for example, holes) into light emitters 21 and 24, respectively, and are electrically connected to light emitters 21 and 24, respectively. First electrodes 22 and 25 can be formed using material that is conductive and light-transmissive. For example, first electrodes 22 and 25 can be formed using indium tin oxide (ITO).

Contact part 23 electrically connects a switching element such as a TFT included in the TFT layer (for example, driver transistor T2), and first electrode 22. Contact part 26 electrically connects a switching element such as a TFT included in the TFT layer (for example, switching transistor T3), and first electrode 25. Contact parts 23 and 26 can be formed using material that is conductive and light-transmissive. For example, contact parts 23 and 26 can be formed using ITO, just like first electrodes 22 and 25. Contact part 23 is one example of the first contact part, and contact part 26 is one example of the second contact part.

In a plan view, contact part 23 is disposed, for example, in a protrusion of first electrode 22 that protrudes toward light emitter 24. Moreover, in a plan view, contact part 26 is disposed, for example, in a protrusion of first electrode 25 that protrudes toward light emitter 21.

In a plan view, contact parts 23 and 26 are preferably disposed between light emitters 21 and 24. Stated differently, in a plan view, contact parts 21 and 24 are preferably disposed between light emitters 23 and 26.

Note that the planar structure of pixel circuit 20 is not limited to the above. For example, the surface areas of light emitters 21 and 24 may be equal. Moreover, for example, at least one of contact part 23 or 26 may be disposed in a position that is not between light emitters 21 and 24.

Note that when organic EL display device 1 supports color display, pixel circuit 20 described with reference to FIG. 16 and FIG. 17 may be applied to each of the first through third subpixel circuits, and, alternatively, may be applied to at least one of the subpixel circuits. For example, pixel circuit 20 may be applied to only the subpixel circuit having the thinnest organic EL element, from among the first through third subpixel circuits. Stated differently, for example, pixel circuit 20 may be applied to only the subpixel circuit having the largest capacitance per unit surface area, from among the first through third subpixel circuits. For example, pixel circuit 20 may be applied to only the first subpixel circuit that emits blue light.

When pixel circuit 20 is applied to only the first subpixel circuit, the second and third subpixel circuits may each include a single organic EL element (for example, organic EL element EL illustrated in FIG. 2). In such cases, the equivalent capacitance of first organic EL element EL1 included in the first subpixel circuit is preferably determined based on the equivalent capacitance of organic EL element EL included in the second subpixel circuit and the equivalent capacitance of organic EL element EL included in the third subpixel circuit. Stated differently, the surface area of light emitter 21 of first organic EL element EL1 is preferably determined based on the equivalent capacitance of organic EL element EL included in the second subpixel circuit and the equivalent capacitance of organic EL element EL included in the third subpixel circuit. Note that hereinafter, equivalent capacitance will also be referred to simply as capacitance.

More specifically, the surface area of light emitter 21 of first organic EL element EL1 may be determined so that the capacitance of first organic EL element EL1 is less than or equal to the greater one of the capacitance of organic EL element included in the second subpixel circuit and the capacitance of organic EL element included in the third subpixel circuit. For example, the surface area of light emitter 21 of first organic EL element EL1 may be determined so that the capacitance of first organic EL element EL1 is equal to one of the capacitance of organic EL element included in the second subpixel circuit and the capacitance of organic EL element included in the third subpixel circuit. This reduces the time required to perform mobile correction in each subpixel circuit.

2. Circuit Operations of Organic EL Display Device

Figure 18:
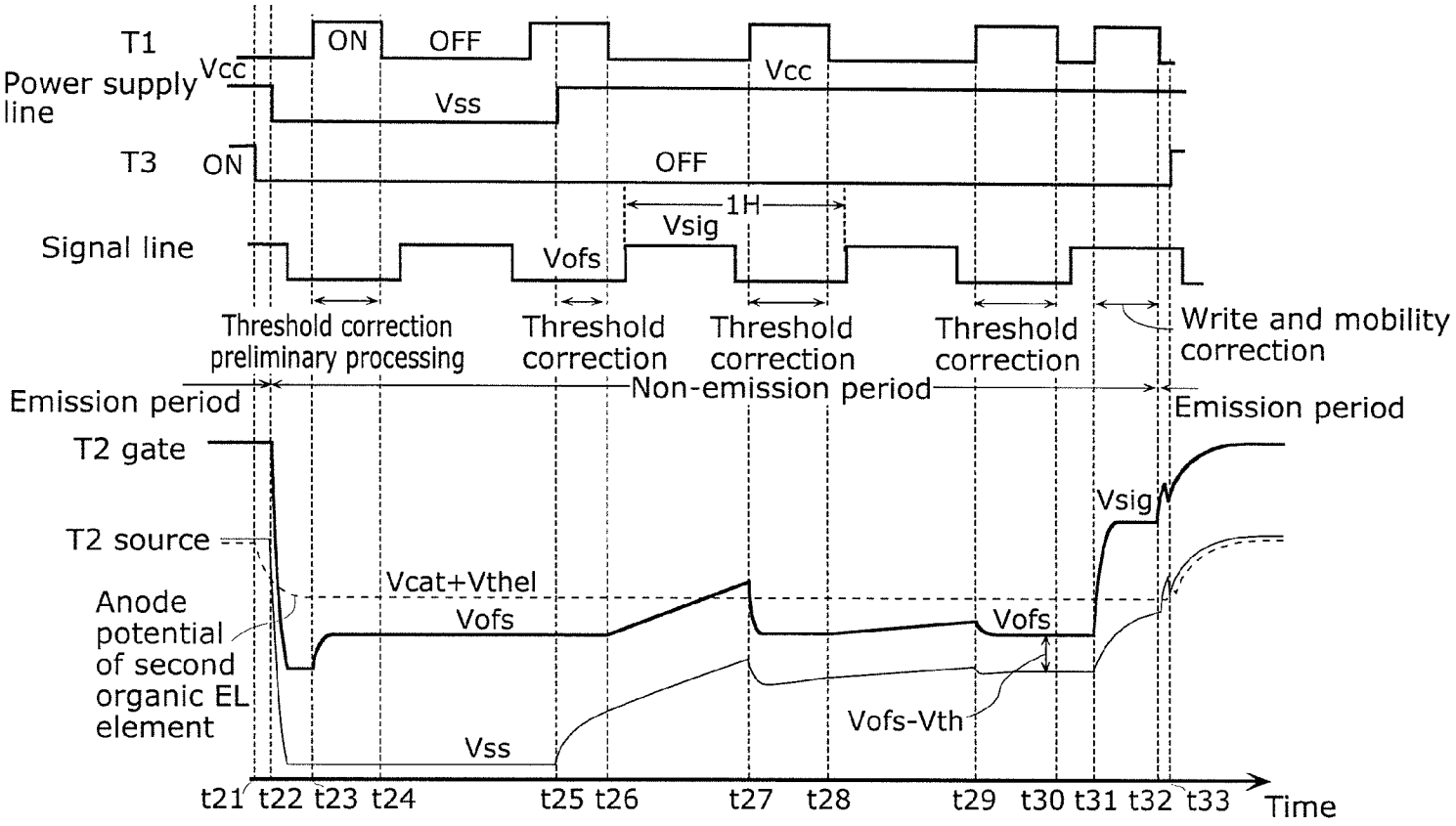
FIG. 18 is a timing chart for describing circuit operations performed by the organic EL display device according to the embodiment.

Next, circuit operations performed by organic EL display device 1 described above will be described with reference to FIG. 18 through FIG. 23. FIG. 18 is a timing chart for describing circuit operations performed by organic EL display device 1 according to the present embodiment. FIG. 18 illustrates changes in the potential of the gate electrode of write transistor T1 (i.e., the potential of scan line 61; either a high potential (ON) or low potential (OFF)), the potential (Vcc or Vss) of power supply line 51, the potential of the gate electrode of switching transistor T3 (i.e., the potential of control line 71; either a high potential (ON) or low potential (OFF)), the potential (Vsig or Vofs) of signal line 41, the potential of gate electrode g of driver transistor T2 ("T2 gate" in FIG. 18), and the potential of source electrode s of driver transistor T2 ("T2 source" in FIG. 18). The dashed line in FIG. 18 indicates changes in the potential of the first electrode (i.e., the anode potential) of second organic EL element EL2. In the present embodiment, potential Vcc is approximately 10V to 20V, potential Vss is approximately −5V to 0V, and potential Vofs is 0V.

Emission Period of Previous Display Frame

In the timing chart illustrated in FIG. 18, the period before time t22 is the emission period in the previous display frame. In the emission period of the previous display frame, the potential of power supply line 51 is high potential Vcc, and write transistor T1 is in a non-conducting state (in an OFF state).

Figure 19:
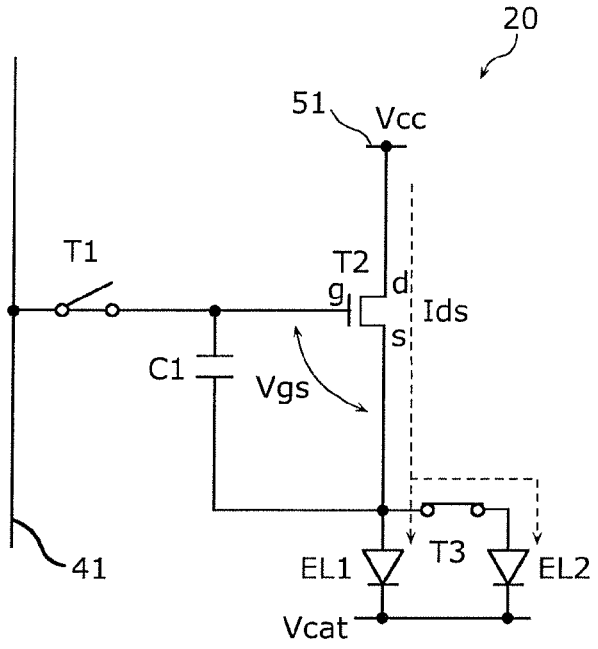
FIG. 19 is a first figure for describing circuit operations performed by the organic EL display device according to the embodiment.

At this time, driver transistor T2 is set so as to operate in the saturation region. Consequently, before time t21, as illustrated in FIG. 19, drive current Ids (drain-source current) dependent on gate-source voltage Vgs of driver transistor T2 is supplied from power supply line 51 to both first organic EL element EL1 and second organic EL element EL2 via driver transistor T2. Accordingly, both first organic EL element EL1 and second organic EL element EL2 emit light of a luminance that is in accordance with the current value of drive current Ids. Note that FIG. 19 is a first figure for describing circuit operations performed by organic EL display device 1 according to the present embodiment.

In the emission period of the display frame, at time t21, the potential of control line 71 transitioning from the high potential side to the low potential side (i.e., from ON to OFF) places switching transistor T3 in a non-conducting state. This stops the flow of current from driver transistor T2 to second organic EL element EL2, which decreases the potential of the first electrode (anode) of second organic EL element EL2. The potential of the first electrode decreasing to a potential equal to Vcat+Vthel after elapse of a given period of time causes second organic EL element EL2 to stop emitting light. Here, Vcat is the potential of the second electrode (i.e., the cathode potential) of second organic EL element EL2, and Vthel is the threshold voltage of second organic EL element EL2.

Switching transistor T3 is in a non-conducting state before an operation that performs threshold correction is started (for example, before time t23). It can also be said that switching transistor T3 is in a non-conducting state before an operation that performs mobility correction is started (for example, before time t31). Note that switching transistor T3 remains in a non-conducting state throughout the non-emission period, for example.

Non-emission Period

Figure 20:
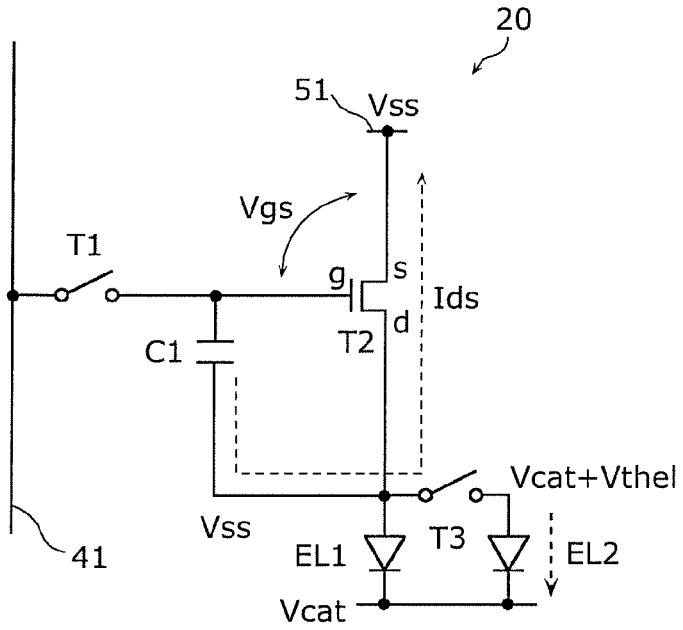
FIG. 20 is a second figure for describing circuit operations performed by the organic EL display device according to the embodiment.

At time t22, the line sequential scanning enters a new display frame (current display frame). Then, as illustrated in FIG. 20, the potential of power supply line 51 switches from high potential Vcc to low potential Vss. Relative to reference potential Vofs of signal line 41, low potential Vss is a potential that is sufficiently lower than Vofs−Vth, and sufficiently low enough to be capable of causing first organic EL element EL1 to not emit light. At time t22, operations for applying a negative bias to first organic EL element EL1 are performed. For example, switching transistor T3 enters a non-conducting state at time t21, which is a point in time before time t22. For example, switching transistor T3 turns OFF before operations for applying a negative bias to first organic EL element EL1 are performed. Note that FIG. 20 is a second figure for describing circuit operations performed by organic EL display device 1 according to the present embodiment.

Here, the potential of the first electrode (anode) of first organic EL element EL1 that is connected to driver transistor T2 is low potential Vss, but since switching transistor T3 is in a non-conducting state, the potential of the first electrode (anode) of second organic EL element EL2 that is connected to switching transistor T3 is held at Vcat+Vthel.

Threshold Correction Preliminary Period and Threshold Correction Period

After time t22, while switching transistor T3 is in a non-conducting state, the threshold correction preliminary operation, the threshold correction operation, and the mobility correction operation described in the above description of the circuit operations of the conventional organic EL display device 901 are performed. During these operations as well, since switching transistor T3 is in a non-conducting state, the potential of the first electrode of second organic EL element EL2 that is connected to switching transistor T3 is held at Vcat+Vthel. Note that time t23 through time t31 respectively correspond to time t2 through time t10 in FIG. 4.

Write and Mobility Correction Period

Next, at time t31, in a state in which the potential of signal line 41 has switched from reference potential Vofs to signal voltage Vsig, the potential of scan line 61 transitioning to the high potential side (i.e., from OFF to ON) starts the write operation and the mobility correction operation. The writing of signal voltage Vsig by write transistor T1 turns gate potential Vg of driver transistor T2 into signal voltage Vsig. At this time, second organic EL element EL2 is not connected to driver transistor T2 since switching transistor T3 is in a non-conducting state. Accordingly, depending on signal voltage Vsig of the image signal, the current flowing through driver transistor T2 (drain-source current Ids) from power supply line 51 flows into storage capacitor C1 and the equivalent capacitor of first organic EL element EL1. Stated differently, in the period from time t31 to time t32, the current flowing through driver transistor T2 does not flow into the equivalent capacitor of second organic EL element EL2. Accordingly, the current flowing through driver transistor T2 is used to charge storage capacitor C1 and the equivalent capacitor of first organic EL element EL1. Stated differently, the equivalent capacitor of second organic EL element EL2 is not charged by the current flowing through driver transistor T2.

As described above, in pixel circuit 20 according to the present embodiment, in the period from time t31 to time t32, the current flowing through driver transistor T2 is used to charge only storage capacitor C1 and the equivalent capacitor of first organic EL element EL1, that is to say, is not used to charge the equivalent capacitor of second organic EL element EL2. In other words, with pixel circuit 20 according to the present embodiment, it is possible to reduce the equivalent capacitances of the equivalent capacitors of the organic EL elements in mobility correction.

Although source potential Vs of driver transistor T2 increases over time as a result of the equivalent capacitor of first organic EL element EL1 being charged, since the equivalent capacitance of the equivalent capacitor connected to driver transistor T2 is smaller than when switching transistor T3 is in a conducting state, the per unit time increment of source potential Vs of driver transistor T2 can be increased. In other words, it is possible to speed up the mobility correction operation. For example, the mobility correction operation can be performed faster than when the mobility correction operation is performed while switching transistor T3 is in a conducting state. Note that performing the mobility correction operation while switching transistor T3 is in a conducting state is equivalent to performing the mobility correction operation in the conventional pixel circuit 920.

Emission Period

At time t32, the potential of scan line 61 transitioning from the high potential side to the low potential side (i.e., from ON to OFF) places write transistor T1 in a non-conducting state, and the write operation ends. This starts the emission period in the current display frame. The period from time t31 to time t32 is a write and mobility correction period.

The potential of control line 71 transitioning from the low potential side to the high potential side (i.e., from OFF to ON) at time t33 places switching transistor T3 in a conducting state. In other words, switching transistor T3 turns ON after the signal write operation completes and write transistor T1 turns OFF. It can also be said that switching transistor T3 turns ON after the write operation that writes, to storage capacitor C1, a voltage supplied via signal line 41.

Figure 21:
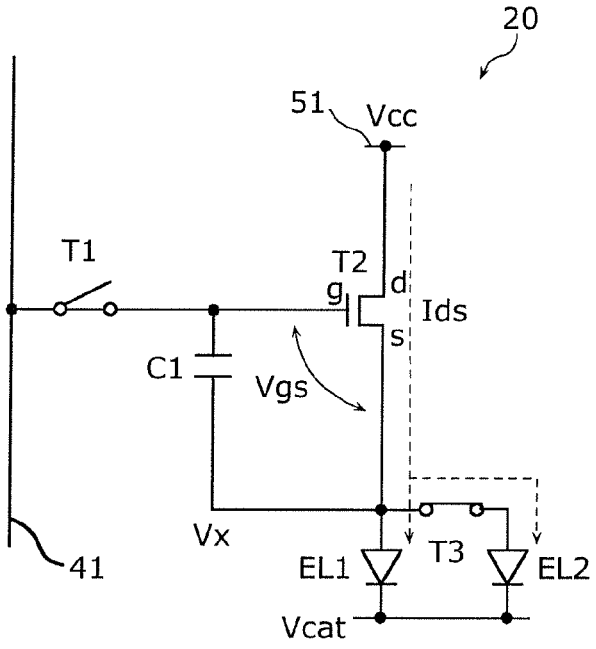
FIG. 21 is a third figure for describing circuit operations performed by the organic EL display device according to the embodiment.

As a result of this operation, the first electrode of second organic EL element EL2 is connected to driver transistor T2 via switching transistor T3, source potential Vs of driver transistor T2 becomes Vx, current flows from driver transistor T2, source potential Vs of driver transistor T2 increases in accordance with the current value, and both first organic EL element EL1 and second organic EL element EL2 emit light, as illustrated in FIG. 21. Note that FIG. 21 is a third figure for describing circuit operations performed by organic EL display device 1 according to the present embodiment. Moreover, potential Vx will be described later.

Note that when write transistor T1 is turned OFF after completion of the signal write operation, gate-source voltage Vgs of driver transistor T2 is held at a constant value by storage capacitor C1. Here, source potential Vs of driver transistor T2 increases due to the current flowing through driver transistor T2. This current is the same in each pixel circuit 20 since variations in characteristics driver transistors T2 are corrected by correction driving realized by the above-described threshold correction and mobility correction.

Note that it is sufficient if switching transistor T3 is OFF in at least the period in which mobility correction is performed. More specifically, it is sufficient if switching transistor T3 is OFF at least from time t31 to time t32. Moreover, when switching transistor T3 is turned off, switching transistor T3 is maintained in the OFF state until after the write operation (after time t32).

Figure 22:
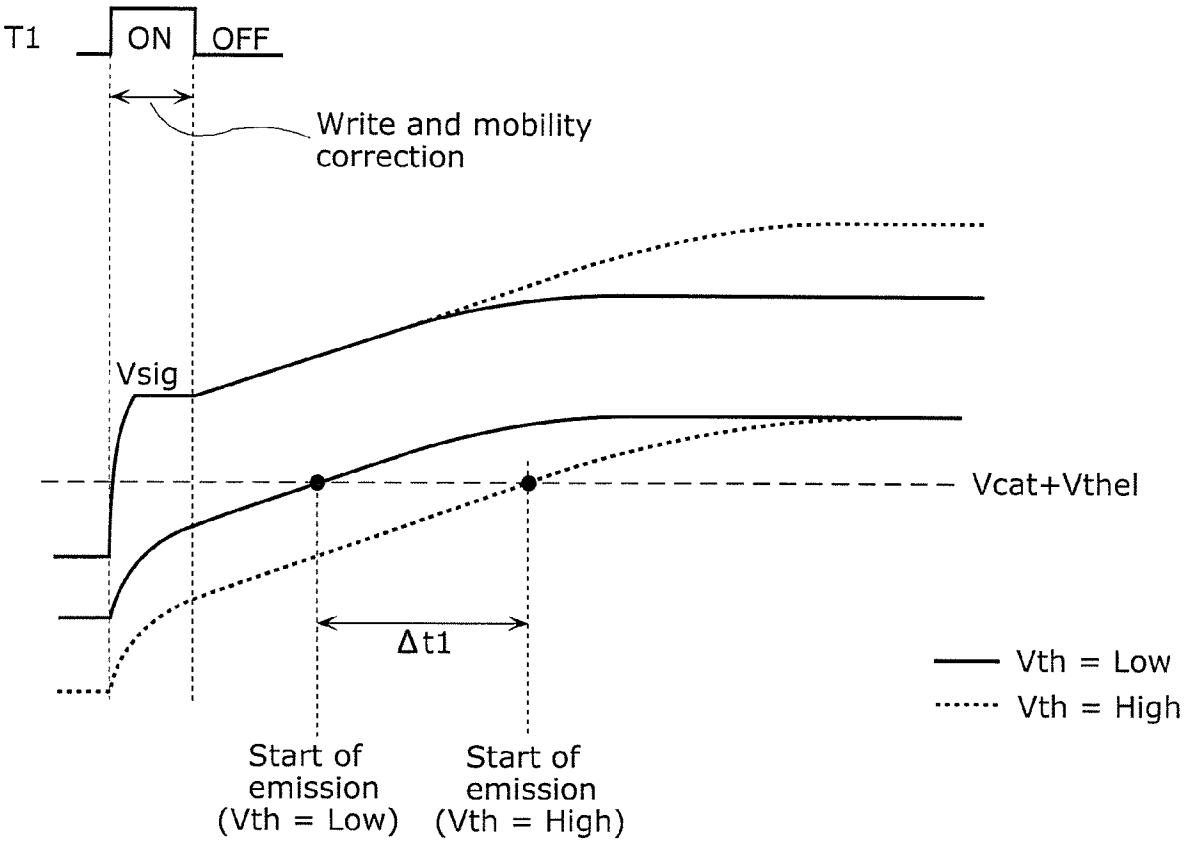
FIG. 22 illustrates a discrepancy in emission timing caused by variations in threshold voltages of driver transistors.
Figure 23:
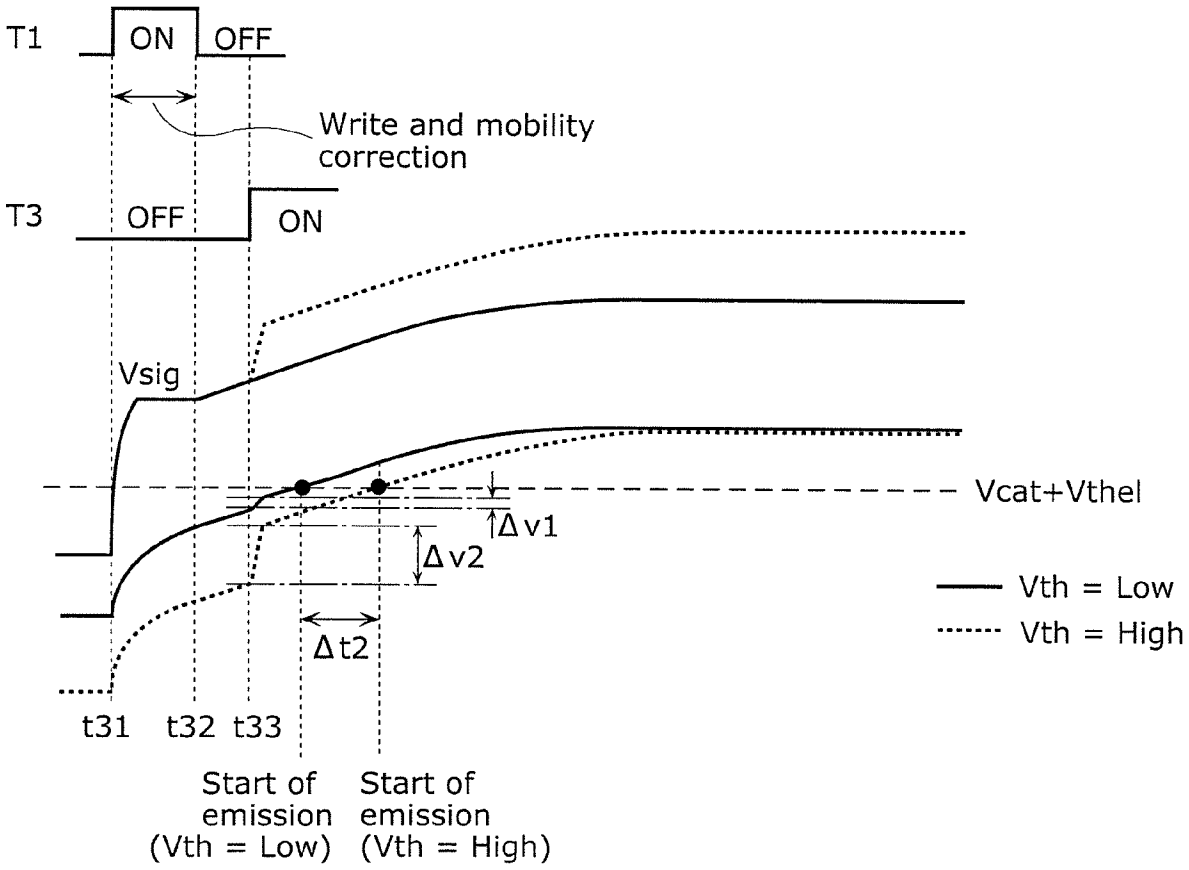
FIG. 23 illustrates that a discrepancy in emission timing caused by variations in threshold voltages of driver transistors can be reduced in the pixel circuit according to the embodiment.

Next, cases in which the threshold voltages of driver transistors T2 differ between pixel circuits 20 will be described with reference to FIG. 22 and FIG. 23. FIG. 22 illustrates a discrepancy in emission timing caused by variations in threshold voltages of driver transistors. In FIG. 22 and FIG. 23, driver transistor T2 source potential Vs is represented on the vertical axes, and time is represented on the horizontal axes. The dashed plotted lines in FIG. 22 and FIG. 23 indicate source potential Vs of driver transistor T2 in a pixel circuit 20 in which threshold voltage Vth of driver transistor T2 is relatively high. The solid plotted lines in FIG. 22 and FIG. 23 indicate source potential Vs of driver transistor T2 in a pixel circuit 20 in which threshold voltage Vth of driver transistor T2 is relatively low.

When write transistor T1 is turned OFF, source potential Vs of driver transistor T2 whose threshold voltage Vth is high is lower than source potential Vs of driver transistor T2 whose threshold voltage Vth is low, as illustrated in FIG. 22. However, if the current flowing through driver transistors T2 is the same, the emission voltage of the organic EL elements in the two pixel circuits 20 will be the same (for example, cathode potential Vcat+organic EL element threshold voltage Vthel illustrated in FIG. 22). In other words, compared to driver transistor T2 whose threshold voltage Vth is low, with driver transistor T2 whose threshold voltage Vth is high, the amount of increase in source potential Vs increases by the difference between threshold voltages Vth. Stated differently, the time at which emission starts (the time at which source potential Vs of driver transistor T2 reaches the sum of threshold voltage Vthel of the organic EL element and cathode potential Vcat) in pixel circuit 20 including driver transistor T2 whose threshold voltage Vth is high is later than the time at which emission starts in pixel circuit 20 including driver transistor T2 whose threshold voltage Vth is low.

Time difference Δt1 between the points in time at which emission starts is expressed as $\Delta t1 \propto \Delta th/Ids$ (Expression 6), where ΔVth is the difference in threshold voltages of driver transistors T2 between pixel circuits 20, and Ids is the drive current flowing at the time of emission. According to Expression 6, when drive current Ids is high (for example, when high-luminance light is emitted), time difference Δt1 is small, and when drive current Ids is low (for example, when low-luminance light is emitted), time difference Δt1 is large. In other words, when low-luminance display is performed in particular, unevenness in the display, which is caused by the difference in emission start times resulting from difference ΔVth in threshold voltages of driver transistors T2, is more likely to be noticeable. This difference ΔVth in threshold voltages of driver transistors T2 between pixel circuits 20 causes a discrepancy in the timing of the start of emission between pixel circuits 20, which manifests as an uneven appearance of the display.

In contrast, in pixel circuit 20 according to the present embodiment, by placing switching transistor T3 in a conducting state (i.e., by turning switching transistor T3 ON) after write transistor T1 is placed in a non-conducting state (i.e., after write transistor T1 is turned OFF), source potential Vs of driver transistor T2 is changed to potential Vx described below. Potential Vx is a value calculated as follows: $Vx=(Cel1\times V1+Cel2\times V2)/(Cel1+Cel2)$ (Expression 7), where Cel1 is the equivalent capacitance of first organic EL element EL1, Cel2 is the equivalent capacitance of second organic EL element EL2, V1 is the anode-cathode potential of first organic EL element EL1 before switching transistor T3 is turned ON, and V2 is the anode-cathode potential of second organic EL element EL2 before switching transistor T3 is turned ON. Note that potential V2 is, for example, Vcat+Vthel.

Among the potentials that determine potential Vx, potential V1 is a value reflecting the characteristics of driver transistor T2, but potential V2 is a value that does not reflect the characteristics of driver transistor T2. Furthermore, by making the value of equivalent capacitance Cel2 greater than the value of equivalent capacitance Cel1, even if threshold voltages Vth of driver transistors T2 vary between pixel circuits 20, the effect that this has on potential Vx can be reduced. This makes it possible to reduce the difference in emission start times resulting from the difference in threshold voltages Vth of driver transistors T2.

Next, this will be described in greater detail with reference to FIG. 23. FIG. 23 illustrates that a discrepancy in emission timing caused by variations in threshold voltages of driver transistors T2 can be reduced in pixel circuit 20 according to present embodiment. Note that FIG. 23 illustrates an example in which the surface areas of light emitters 21 and 24 are equal. Stated differently, FIG. 23 illustrates an example in which equivalent capacitance Cel1 of first organic EL element EL1 and equivalent capacitance Cel2 of second organic EL element EL2 are equal.

As illustrated in FIG. 23, when there is variation between threshold voltages Vth, there is a discrepancy in source potentials Vs of driver transistors T2 between pixel circuits 20 in the period from time t31 to time t33 that is dependent on this variation between threshold voltages Vth. From time t31 to time t33, among first organic EL element EL1 and second organic EL element EL2, only first organic EL element EL1 is connected to driver transistor T2.

Next, at time t33, when switching transistor T3 enters a conducting state, source potential Vs of driver transistor T2 changes from potential V1 to potential Vx, based on Expression 7. When equivalent capacitances Cel1 and Cel2 are the same, potential Vx becomes a value that is intermediate between potential V1 and potential V2. Stated differently, potential Vx becomes a value that is intermediate between potential V1 and Vcat+Vthel.

Here, the amount of increase in source potential Vs of driver transistor T2 when switching transistor T3 enters a conducting state at time t33 varies depending on threshold voltage Vth of that driver transistor T2.

Source potential Vs at time t33 of driver transistor T2 whose threshold voltage Vth is relatively low is higher than source potential Vs at time t33 of driver transistor T2 whose threshold voltage Vth is relatively high. At time t33, source potential Vs of driver transistor T2 whose threshold voltage Vth is relatively low is closer to the potential at which organic EL element starts emitting light (i.e., Vcat+Vthel) than source potential Vs of driver transistor T2 whose threshold voltage Vth is relatively high is. Moreover, the potential at which first organic EL element EL1 and second organic EL element EL2 emit light is the same regardless of threshold voltage Vth of driver transistor T2, and is equal to, for example, Vcat+Vthel.

In pixel circuit 20 including driver transistor T2 whose threshold voltage Vth is relatively low, at time t33, source potential Vs changes by amount of increase Δv1. Assuming equivalent capacitances Cel1 and Cel2 are the same, amount of increase Δv1 is equal to half the difference between potential V1 and potential (Vcat+Vthel) at time t33. In the case of driver transistor T2 whose threshold voltage Vth is relatively low, since source potential Vs of such a driver transistor T2 is relatively high at time t33, amount of increase Δv1 is small.

On the other hand, in pixel circuit 20 including driver transistor T2 whose threshold voltage Vth is relatively high, at time t33, source potential Vs changes by amount of increase Δv2. Assuming equivalent capacitances Cel1 and Cel2 are the same, amount of increase Δv2 is equal to half the difference between potential V1 and potential (Vcat+Vthel) at time t33. In the case of driver transistor T2 whose threshold voltage Vth is relatively high, since source potential Vs of such a driver transistor T2 is relatively low at time t33, amount of increase Δv2 is greater than amount of increase Δv1. Potential Vx is, for example, a potential equal to potential V1 added with amount of increase Δv2.

As described above, by switching transistor T3 turning ON at time t33, source potential Vs of driver transistor T2 in pixel circuit 20 including driver transistor T2 whose threshold voltage Vth is relatively high increases more so than source potential Vs of driver transistor T2 in pixel circuit 20 including driver transistor T2 whose threshold voltage Vth is relatively low. In other words, it possible to reduce the difference in emission start times resulting from the discrepancy in threshold voltages Vth of driver transistors T2. Accordingly, since it is possible to reduce time difference Δt2 between emission start times of pixel circuits 20, it is possible to inhibit a difference in emission start times between pixel circuits 20 caused by discrepancies in threshold voltages Vth, which inhibits the manifestation of an uneven appearance of the display.

Note that from the perspective of increasing amount of increase Δv2, that is to say, decreasing time difference Δt2 between emission start times, the surface area of second organic EL element EL2 that is connected to switching transistor T3 is preferably larger than the surface area of first organic EL element EL1 that is connected to driver transistor T2. Furthermore, the timing at which switching transistor T3 is turned OFF is preferably a timing at which the potential of the first electrode (anode) of second organic EL element EL2 that is connected to switching transistor T3 is not affected by variations in characteristics driver transistors T2. This timing is, for example, before the start of the threshold correction operation. Furthermore, the timing at which switching transistor T3 is turned OFF is preferably before application of the reverse bias that prevents source potential Vs of driver transistor T2 from significantly decreasing upon switching transistor T3 turning back ON (for example, before time t22).

Pixel circuit 20 configured as described above not only performs mobility correction operation at high speed, but can also reduce variations in time difference in emission start times that result from variations in threshold voltages of driver transistors T2. Furthermore, since the configuration of pixel circuit 20 allows for a smaller sized driver transistor T2, the effect of coupling noise from an adjacent line at the time of light emission can be reduced. Consequently, pixel circuit 20 can reproduce an image with little cut-off lines and uneven regions.

Moreover, as described above, in a single pixel circuit 20, the organic EL element is divided into first organic EL element EL1 and second organic EL element EL2, and second organic EL element EL2 is connected to source electrode s of driver transistor T2 via switching transistor T3. In a state in which switching transistor T3 is turned OFF in the mobility correction period and the driver transistor size is small, the amount of increase of source potential Vs of driver transistor T2 during mobility correction can be increased. Consequently, the time required for mobility correction can be reduced, and an image with little cut-off lines and uneven regions can be reproduced.

Moreover, since setting the timing that switching transistor T3 turns OFF to a timing that is before a threshold correction operation and setting the timing that switching transistor T3 turns ON to a timing that is after a signal write operation makes it is possible to inhibit the manifestation of an uneven appearance of the display caused by difference in emission start times resulting from discrepancies in threshold voltages Vth of driver transistors T2 between pixel circuits 20, an image quality characterized by little cut-off lines and uneven regions can be achieved. Moreover, since the linearity of luminance relative to the emission period is maintained, there is a low probability that clipped blacks when the number of gradations is low will occur, even when light emission duty is shortened.

3. Technical Advantages, etc.

As described above, pixel circuit 20 according to the present embodiment includes: driver transistor T2 configured to supply a current dependent on a voltage supplied via signal line 41; write transistor T1 connected between signal line 41 and gate electrode g of driver transistor T2; first organic EL element EL1 connected to one electrode of the driver transistor, the one electrode being one of source electrode s and drain electrode d of driver transistor T2; switching transistor T3 connected to the one electrode of driver transistor T2; and second organic EL element EL2 connected to the one electrode of driver transistor T2 via switching transistor T3. Pixel circuit 20 is configured to perform mobility correction that corrects a mobility of driver transistor T2. Switching transistor T3 is configured to turn ON after a write operation that writes the voltage supplied via signal line 41 and turn OFF before an operation that performs the mobility correction of driver transistor T2 begins. Note that first organic EL element EL1 is one example of the first light emitting element, and second organic EL element EL2 is one example of the second light emitting element.

With this, in the period in which the mobility correction of driver transistor T2 is performed, among first organic EL element EL1 and second organic EL element EL2, only first organic EL element EL1 is connected to driver transistor T2. Accordingly, in the period in which mobility correction is performed, the current flowing through driver transistor T2 is used for charging equivalent capacitor Cel1 of first organic EL element EL1. In other words, in the period in which mobility correction is performed, the capacitance of organic EL element connected to driver transistor T2 can be reduced. A reduction in the capacitance of the organic EL element results in a decrease in the time required to correct mobility. Therefore, pixel circuit 20 according to the present embodiment can speed up mobility correction.

Moreover, in the emission period (the period after the write operation) in which pixel circuit 20 emits light, as a result of switching transistor T3 being ON, it is possible to inhibit a reduction in luminance at the time of emission.

Moreover, pixel circuit 20 further includes a first subpixel circuit configured to emit light of a first color and a second subpixel circuit configured to emit light of a second color different from the first color. Among the first subpixel circuit and the second subpixel circuit, only the first subpixel circuit includes switching transistor T3 and second organic EL element EL2.

With this configuration, switching transistor T3 is provided only in a subpixel circuit that emits a desired color light. Compared to when switching transistor T3 is provided in each subpixel circuit, with the above configuration of pixel circuit 20, the number of elements forming the circuit can be inhibited from increasing.

Moreover, pixel circuit 20 further includes a third subpixel circuit configured to emit light of a third color different from the first color and the second color. Among the first subpixel circuit, the second subpixel circuit, and the third subpixel circuit, only the first subpixel circuit includes switching transistor T3 and second organic EL element EL2. Note that the first color is blue, the second color is red, and the third color is green.

With this, only the subpixel circuit that includes an organic EL element that emits blue light, which is typically the thinnest organic EL element—that is to say, the highest capacitance organic EL element—includes switching transistor T3 and the like. Accordingly, since the mobility correction for a subpixel circuit that requires the most time to perform the mobility correction can be sped up, the mobility correction in pixel circuit 20 can be efficiently sped up. Furthermore, by turning switching transistor T3 ON at the time of emission, the surface area of organic EL element increases, so the current density at the time of emission can be reduced. Since the lifespan of an organic EL element that emits blue light is typically shorter than the lifespan of organic EL elements that emit light of other colors, by reducing the current density at the time of emission as described above, the lifespan of the organic EL elements that emit blue light can be extended.

Moreover, a capacitance of first organic EL element EL1 included in the first subpixel circuit is equal to one of a capacitance of an organic EL element included in the second subpixel circuit and a capacitance of an organic EL element included in the third subpixel circuit.

With this, the time required to perform mobility correction in one of the second subpixel circuit and the third subpixel circuit can be made to be the same as the time required to perform mobility correction in the first subpixel circuit. Accordingly, it is easy to determine the time to perform mobility correction.

Moreover, an operation that applies a negative bias to first organic EL element EL1 before the operation that performs the mobility correction of driver transistor T2 is present in pixel circuit 20. Switching transistor T3 is configured to turn OFF before the negative bias is applied to first organic EL element EL1.

According to this configuration, since a negative bias is not applied to second organic EL element EL2, the anode potential of second organic EL element EL2 can be inhibited from drastically reducing. In the non-emission period, the anode potential of second organic EL element EL2 can be maintained at a potential of a magnitude that keeps second organic EL element EL2 on the verge of emitting light (for example, Vcat+Vthel). Accordingly, by turning switching transistor T3 ON at the time of emission, source potential Vs of driver transistor T2 can be T2 increased. Accordingly, in the emission period, first organic EL element EL1 and second organic EL element EL2 can be caused to emit light for short periods of time. Moreover, even when there are variations in threshold voltages Vth of driver transistors T2 between pixel circuits 20, discrepancies in emission start timing between pixel circuits 20 caused by the variations can be inhibited.

Moreover, the surface area of second organic EL element EL2 is larger than the surface area of first organic EL element EL1.

With this configuration, by turning switching transistor T3 ON at the time of emission, source potential Vs of driver transistor T2 can be T2 further increased. Accordingly, in the emission period, first organic EL element EL1 and second organic EL element EL2 can be caused to emit light for even shorter periods of time. Moreover, even when there are variations in threshold voltages Vth of driver transistors T2 between pixel circuits 20, discrepancies in emission start timing between pixel circuits 20 caused by the variations can be further inhibited.

Moreover, first organic EL element EL1 and second organic EL element EL2 have a top-emission structure. First organic EL element EL1 includes light emitter 21 configured to emit light, and contact part 23 configured to connect an anode of first organic EL element EL1 and a TFT layer. Second organic EL element EL2 includes light emitter 24 configured to emit light, and contact part 26 configured to connect an anode of second organic EL element EL2 and a TFT layer. In a plan view of pixel circuit 20, contact parts 23 and 26 are disposed between light emitters 21 and 24.

Note that light emitter 21 is one example of the first light emitter, and light emitter 24 is one example of the second light emitter. Moreover, contact part 23 is one example of the first contact part, and contact part 26 is one example of the second contact part.

With this configuration, contact parts 23 and 26, which are parts that do not emit light, can be collectively disposed between light emitters 21 and 24. By, for example, forming the first electrode (anode) in this state, it is possible to improve manufacturing efficiency. Moreover, the surface areas of light emitters 21 and 24 can be enlarged.

Moreover, each of the first light emitting element and the second light emitting element is an organic EL element. For example, first organic EL element EL1 is one example of the first light emitting element, and second organic EL element EL2 is one example of the second light emitting element.

With this configuration, pixel circuit 20 is applied to organic EL display device 1 that includes pixel circuits through which emission current for causing the organic EL elements to emit light flows. By applying the above-described pixel circuit 20 to organic EL display device 1 that includes light emitting elements that are prone to generating noise, display quality and sensing ability can be efficiently improved.

Moreover, as described above, organic EL display device 1 according to the present embodiment includes the above-described pixel circuit 20, horizontal selector 40 configured to apply the voltage (image signal) to signal line 41; write scanner 60 configured to control write transistor T1; power supply scanner 50 configured to apply a potential to source electrode s or drain electrode d of driver transistor T2; and switch scanner 70 configured to control switching transistor T3. Note that organic EL display device 1 is one example of the display device.

This allows for sufficient mobility correction since the mobility correction of driver transistor T2 in pixel circuit 20 can be sped up. Consequently, when organic EL display device 1 includes a plurality of pixel circuits 20, image unevenness (i.e., image non-uniformity) resulting from variations in mobility μ between pixel circuits 20 can be reduced.

Variation of Embodiment

Figure 24:
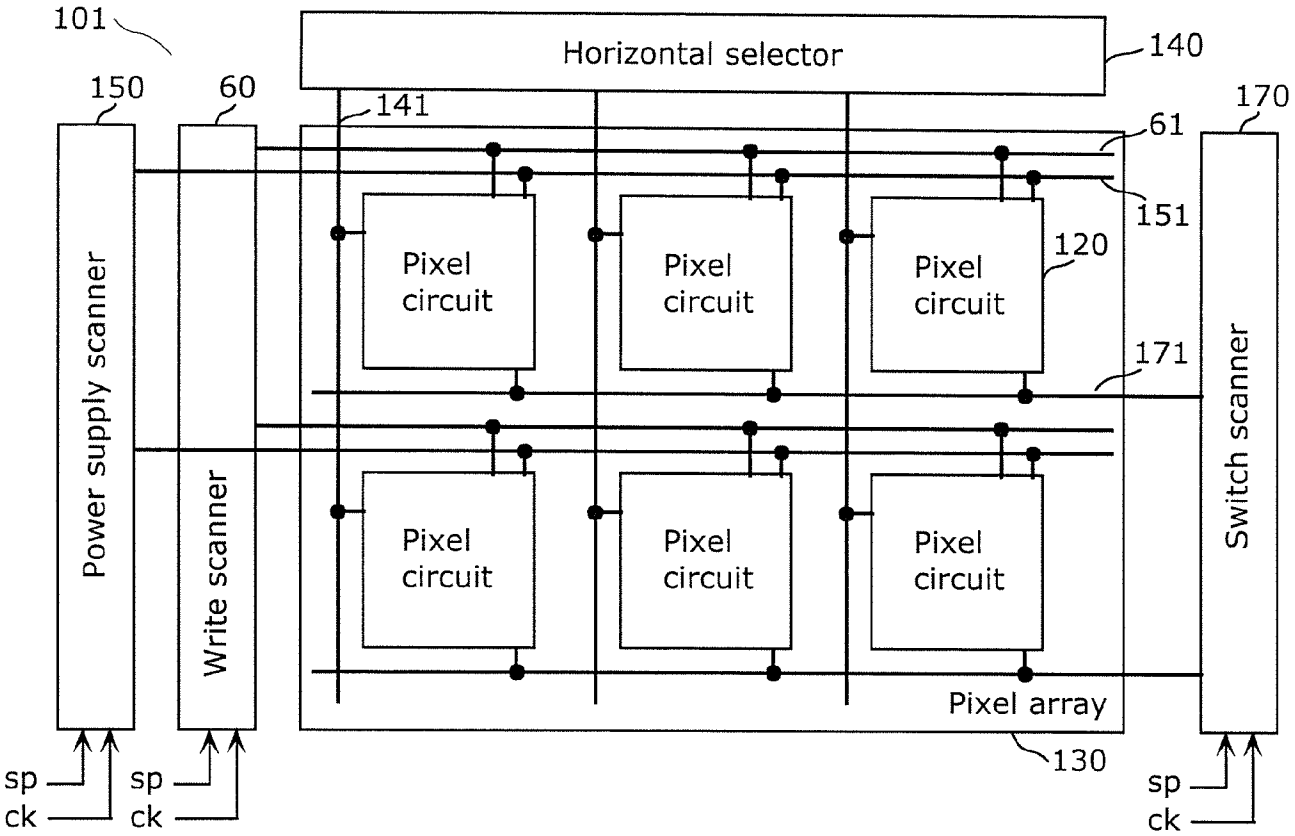
FIG. 24 illustrates a schematic configuration of an organic EL display device according to a variation of the embodiment.

First, a schematic configuration of organic EL display device 101 according to the present variation will be described with reference to FIG. 24 and FIG. 25. FIG. 24 illustrates a schematic configuration of organic EL display device 101 according to the present variation. Pixel circuit 120 included in organic EL display device 101 according to the present variation differs from pixel circuit 20 according to the embodiment in that a P-channel transistor is used as the driver transistor. The following description of pixel circuit 120 and organic EL display device 101 according to the present variation will focus on the points of difference from pixel circuit 20 and organic EL display device 1 according to the embodiment. Moreover, configurations that are the same as or similar to pixel circuit 20 or organic EL display device 1 according to the embodiment share the same reference signs as those in pixel circuit 20 and organic EL display device 1. As such, repeated explanations of like elements are omitted or simplified.

As illustrated in FIG. 24, organic EL display device 101 according to the present variation includes pixel array 130, horizontal selector 140, power supply scanner 150, write scanner 60, and switch scanner 170. Pixel array 130 is comprised of pixel circuits 120 arranged in a two-dimensional matrix. Each pixel circuit 120 includes an organic EL element. Horizontal selector 140, power supply scanner 150, write scanner 60, and switch scanner 170 collectively form a drive circuit unit (drive unit) disposed in the vicinity of pixel array 130.

Each pixel row in pixel array 130 is provided with power supply line 151, scan line 61, and control line 171 that extend parallel to the row direction (the direction in which pixel circuits 120 are arranged in a single pixel row) relative to the m rows and n columns of pixels. Moreover, in pixel array 130, each pixel column is provided with signal line 141 that extends parallel to the column direction (the direction in which pixel circuits 120 are arranged in a single pixel column) relative to the m rows and n columns of pixels. Each power supply line 151 is connected to the output terminal of the corresponding pixel row of power supply scanner 150.

Each signal line 141 is connected to the output terminal of the corresponding pixel column of horizontal selector 140. Each power supply line 151 is connected to the output terminal of the corresponding pixel row of power supply scanner 150. Each scan line 61 is connected to the output terminal of the corresponding pixel row of write scanner 60. Each control line 171 is connected to the output terminal of the corresponding pixel row of switch scanner 170. Moreover, each control line 171 is connected to the gate electrodes of the switching transistors (to be described later; for example, switching transistor T3 illustrated in FIG. 25).

Horizontal selector 140 (signal line drive circuit) is a drive circuit that applies an image signal to signal line 141.

Horizontal selector 140 selectively outputs signal voltage Vsig of the image signal and reference potential Vofs. Signal voltage Vsig is dependent on luminance information supplied from a signal supply source. Here, reference potential Vofs is a voltage that serves as a reference for signal voltage Vsig of an image signal (for example, a voltage corresponding to a black level of an image signal).

Signal voltage Vsig and reference potential Vofs output from horizontal selector 140 are written to pixel circuits 120 in pixel array 130 via signal line 141 on a row-by-row basis for pixel rows selected via scanning by write scanner 60. In other words, horizontal selector 140 employs a line sequential writing driving mode in which signal voltage Vsig is written on a row-by-row basis.

Power supply scanner 150 (power supply scan circuit) is configured of, for example, a shift register circuit that sequentially shifts start pulses sp in synchronization with clock pulse ck. Power supply scanner 150 switches between supplying cathode potential Vcat and supplying third potential Vdd, which is higher than cathode potential Vcat, to power supply line 151, in synchronization with the line sequential scanning by write scanner 60. This switching between cathode potential Vcat and third potential Vdd (switching between power supply potentials) controls the light emission and non-emission states of pixel circuits 120.

Switch scanner 170 is configured of, for example, a shift register circuit that sequentially shifts start pulses sp in synchronization with clock pulse ck. When writing a signal voltage of an image signal to each pixel circuit 170 of pixel array 130, switch scanner 120 sequentially supplies switch scan signals to control line 171, thereby scanning (line sequential scanning) pixel circuits 130 of pixel array 120 in succession on a row-by-row basis.

Next, pixel circuits 120 included in organic EL display device 101 configured as described above will be described with reference to FIG. 25. FIG. 25 illustrates a circuit diagram of pixel circuit 120 according to the present variation.

Figure 25:
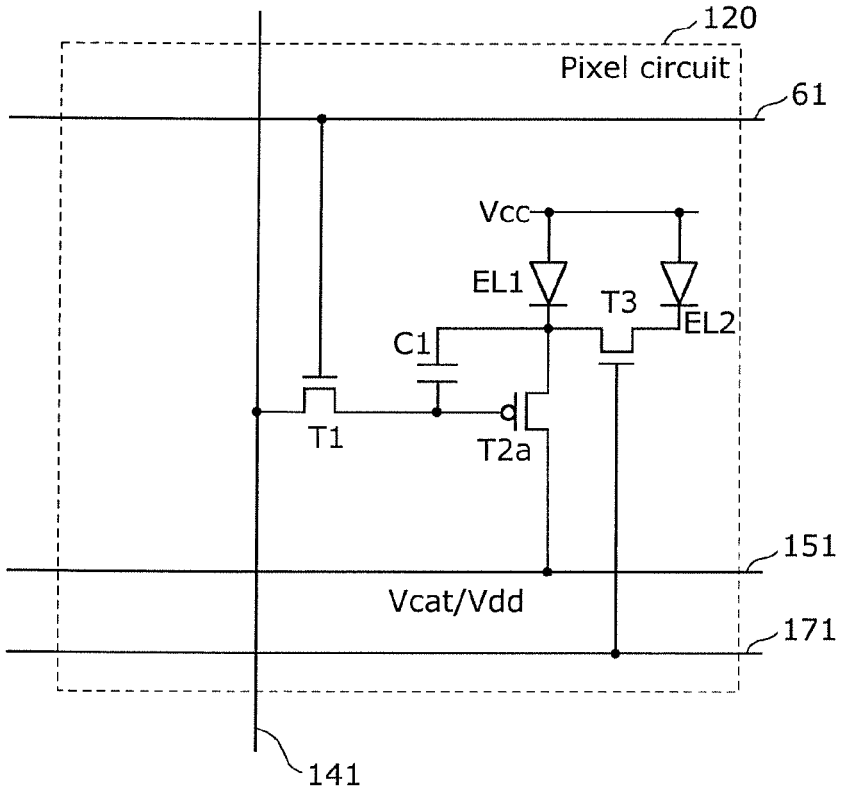
FIG. 25 illustrates a circuit diagram of a pixel circuit according to the variation of the embodiment.

As illustrated in FIG. 25, pixel circuit 120 is a circuit that causes organic EL elements EL to emit light at a luminance that corresponds to the image signal, and includes first organic EL element EL1, second organic EL element EL2, storage capacitor C1, write transistor T1, and driver transistor T2*a*, and switching transistor T3. Pixel circuit 120 may further include, for example, a reference transistor and an initialization transistor. The reference transistor is a thin film transistor for applying a reference voltage to storage capacitor C1, and the initialization transistor is a thin film transistor for initializing the potential of second electrodes of first organic EL element EL1 and second organic EL element EL2.

First organic EL element EL1 is a light emitting element including a first electrode and a second electrode, just like first organic EL element EL1 according to the embodiment. In the example illustrated in FIG. 25, the first electrode and the second electrode are respectively the anode and the cathode of first organic EL element EL1.

Second organic EL element EL2 is a light emitting element including a first electrode and a second electrode, just like second organic EL element EL2 according to the embodiment. In the example illustrated in FIG. 25, the first electrode and the second electrode are respectively the anode and the cathode of second organic EL element EL2.

The first electrode of first organic EL element EL1 and the first electrode of second organic EL element EL2 are connected to an anode power supply line. The anode power supply line is supplied with first potential Vcc (anode potential). In the present variation, first potential Vcc is approximately 20V. The anode power supply line is wired commonly to all pixel circuits 120.

The second electrode of first organic EL element EL1 is connected to source electrode s of driver transistor T2*a* and storage capacitor C1. The second electrode of first organic EL element EL1 is connected to source electrode s of driver transistor T2*a* without switching transistor T3 being disposed therebetween. For example, the second electrode of first organic EL element EL1 is directly connected to source electrode s of driver transistor T2*a*. The second electrode of second organic EL element EL2 is connected to one of the source electrode or the drain electrode of switching transistor T3. The second electrode of second organic EL element EL2 is connected to source electrode s of driver transistor T2*a* via switching transistor T3.

Storage capacitor C1 is an element for storing voltage, and is connected between gate electrode g and source electrode s of driver transistor T2*a*.

Write transistor T1 is a thin film transistor for applying voltage that corresponds to the image signal to storage capacitor C1. Write transistor T1 is connected between signal line 141 to which the image signal is applied and gate electrode g of driver transistor T2*a*. More specifically, signal line 141 is connected to one of the drain electrode and the source electrode of write transistor T1, and storage capacitor C1 and gate electrode g of driver transistor T2*a* are connected to the other of the drain electrode and the source electrode of write transistor T1. Scan line 61 is connected to the gate electrode of write transistor T1. For example, write transistor T1 enters an ON state in accordance with an ON signal, and stores voltage corresponding to the image signal in storage capacitor C1. For example, an N-channel TFT can be used as write transistor T1, but the conductivity type of write transistor T1 is not limited to this example.

Driver transistor T2*a* is a P-channel thin film transistor that is connected to the second electrode (cathode) of first organic EL element EL1 and connected to the second electrode (cathode) of second organic EL element EL2 via switching transistor T3, and supplies current dependent on the voltage stored in storage capacitor C1 to first organic EL element EL1 and second organic EL element EL2. Source electrode s of driver transistor T2*a* is connected to the second electrode of first organic EL element EL1 and connected to the second electrode of second organic EL element EL2 via switching transistor T3, and drain electrode d of driver transistor T2*a* is connected to power supply line 151. Power supply line 151 is selectively supplied with cathode potential Vcat and third potential Vdd from power supply scanner 150.

Note that depending on the relationship between the potential of the second electrode of an organic EL element and the potential supplied from power supply line 151, the positional relationship of source electrode s and drain electrode d in driver transistor T2*a* can be changed from the relationship illustrated in FIG. 25.

Figure 26:
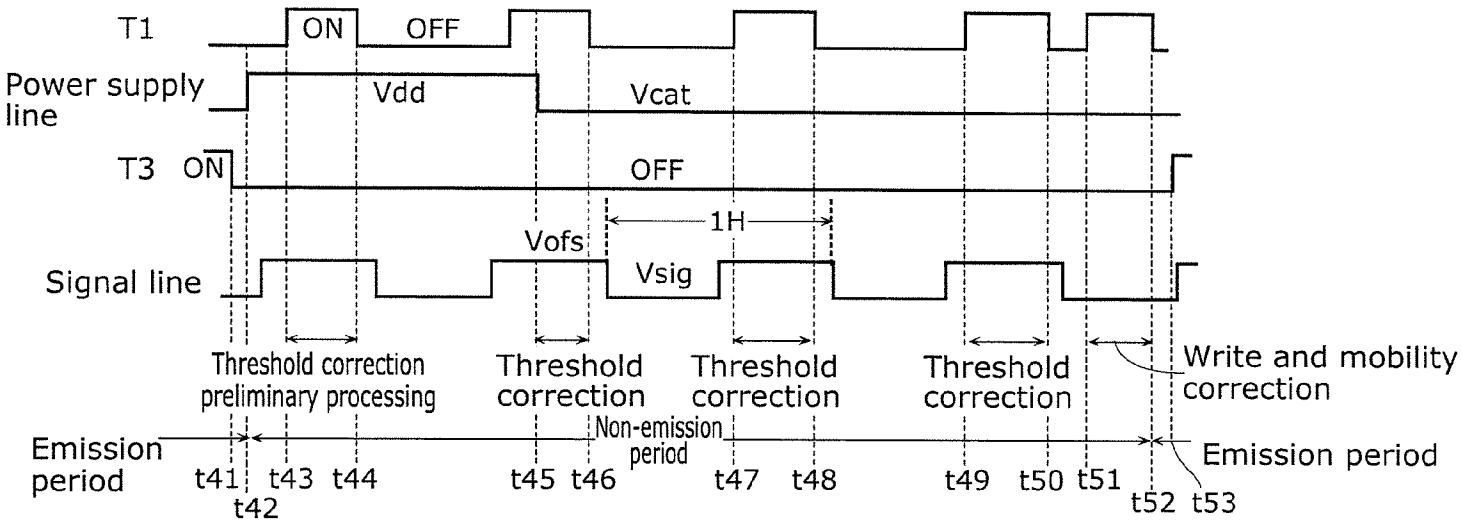
FIG. 26 is a timing chart for describing circuit operations performed by the organic EL display device according to the variation of the embodiment.

Next, circuit operations performed by organic EL display device 101 according to the present variation will be described with reference to FIG. 26. FIG. 26 is a timing chart for describing circuit operations performed by organic EL display device 101 according to the present variation. FIG. 26 illustrates changes in the potential of the gate electrode of write transistor T1 (i.e., the potential of scan line 61; either a high potential (ON) or low potential (OFF)), the potential (Vcat or Vdd) of power supply line 151, the potential of the gate electrode of switching transistor T3 (i.e., the potential of control line 171; either a high potential (ON) or a low potential (OFF)), and the potential (Vsig or Vofs) of signal line 141. In the present variation, potential Vcat is approximately 0V, potential Vdd is approximately 25V, and potential Vofs is approximately 20V.

Emission Period of Previous Display Frame

In the timing chart illustrated in FIG. 26, the period before time t42 is the emission period in the previous display frame. In the emission period of the previous display frame, the potential of power supply line 151 is cathode potential Vcat, and write transistor T1 is in a non-conducting state.

At this time, driver transistor T2*a* is set so as to operate in the saturation region. Consequently, before time t41, drive current Ids (drain-source current) that is dependent on gate-source voltage Vgs of driver transistor T2*a* is supplied from the anode power supply line to both first organic EL element EL1 and second organic EL element EL2. Accordingly, both first organic EL element EL1 and second organic EL element EL2 emit light of a luminance that is in accordance with the current value of the drive current.

In the emission period of the display frame, at time t41, the potential of control line 171 transitioning from the high potential side to the low potential side (i.e., from ON to OFF) places switching transistor T3 in a non-conducting state. This stops the flow of current from the anode power supply line to second organic EL element EL2, which causes second organic EL element EL2 to stop emitting light.

Switching transistor T3 is in a non-conducting state before an operation that performs threshold correction is started (for example, before time t43). It can also be said that switching transistor T3 is in a non-conducting state before an operation that performs mobility correction is started (for example, before time t51). Note that switching transistor T3 is in a non-conducting state throughout the non-emission period, for example.

Non-Emission Period

At time t42, the line sequential scanning enters a new display frame (current display frame). Then, the potential of power supply line 151 switches from cathode potential Vcat to third potential Vdd. Relative to anode potential Vcc, third potential Vdd is a potential that is sufficiently high enough to cause first organic EL element EL1 to not emit light.

Threshold Correction Preliminary Period

Next, the potential of scan line 61 transitioning from the low potential side to the high potential side (i.e., from OFF to ON) at time t43 places write transistor T1 in a conducting state.

At this time, since reference potential Vofs is supplied from horizontal selector 140 to signal line 141, gate potential Vg of driver transistor T2*a* becomes reference potential Vofs. Moreover, source potential Vs of driver transistor T2*a* is a potential that is sufficiently higher than reference potential Vofs, that is to say, is third potential Vdd.

At this time, gate-source voltage Vgs of driver transistor T2*a* is Vofs−Vdd. Here, if Vofs−Vdd is not less than threshold voltage Vth of driver transistor T2*a*, the threshold correction operation (to be described later) cannot be performed, so it is necessary to set Vofs−Vdd so as to satisfy the potential relation Vofs−Vdd<Vth (Expression 8).

In this way, initialization processing that fixes gate potential Vg of driver transistor T2*a* to reference potential Vofs and fixes source potential Vs to third potential Vdd is preliminary processing performed before threshold correction operation (to be described later) (i.e., is threshold correction preliminary processing). Accordingly, reference potential Vofs and third potential Vdd are the initialization potentials of gate potential Vg and source potential Vs of driver transistor T2*a*, respectively.

The potential of scan line 61 transitioning from the high potential side to the low potential side (i.e., from ON to OFF) at time t44 ends the threshold correction preliminary period. The period from time t43 to time t44 is a threshold correction preliminary period.

Threshold Correction Period

Next, at time t45, when the potential of power supply line 151 switches from third potential Vdd to cathode potential Vcat while write transistor T1 is in a conducting state, the second electrode of first organic EL element EL1 becomes the source electrode s of driver transistor T2*a*, and current flows to driver transistor T2*a*. Consequently, the threshold correction operation starts in a state in which gate potential Vg of driver transistor T2*a* is maintained at reference potential Vofs. In other words, source potential Vs of driver transistor T2*a* begins to decrease from gate potential Vg toward a potential calculated by adding threshold voltage |Vth| of driver transistor T2*a* (i.e., Vofs+|Vth|).

Here, for convenience, using reference potential Vofs (i.e., the initialization voltage) of gate potential Vg of driver transistor T2*a* as a reference, the operation (process) for causing source potential Vs to change from reference potential Vofs toward a voltage calculated by adding threshold voltage |Vth| of driver transistor T2*a*, will be referred to as a threshold correction operation (threshold correction processing). As this threshold correction operation progresses, in time, gate-source voltage Vgs of driver transistor T2*a* converges to threshold voltage Vth of driver transistor T2*a*. A voltage corresponding to this threshold voltage Vth is stored in storage capacitor C1.

Note that in the periods in which a threshold correction operation is performed, in order to cause current to flow to the storage capacitor C1 side and not to flow to the first organic EL element EL1 side, first potential Vcc of the anode power supply line is set so as to place first organic EL element EL1 in a cut-off state (high-impedance state).

Next, at time t46, the potential of scan line 61 transitioning to the low potential side (i.e., from ON to OFF) places write transistor T1 in a non-conducting state. Write transistor T1 enters a non-conducting state at time t46, which is a point in time after elapse of a first period after time t45. At this time, gate electrode g of driver transistor T2*a* is in a floating state as a result of electrically disconnecting from signal line 141. However, since gate-source voltage Vgs is less than threshold voltage Vth of driver transistor T2*a*, current (drain-source current Ids) flows, and the gate and source potentials of driver transistor T2*a* decrease.

Next, at time t47, in the period in which the potential of signal line 141 is reference potential Vofs (for example, at the point in time the potential of signal line 141 becomes reference potential Vofs), write transistor T1 is placed in a conducting state, and threshold correction operation is started once again. By repeating this operation, the value of gate-source voltage Vgs of driver transistor T2*a* eventually becomes threshold voltage Vth.

Next, at time t48, the potential of scan line 61 transitioning to the low potential side (i.e., from ON to OFF) places write transistor T1 in a non-conducting state. Write transistor T1 enters a non-conducting state at time t48, which is a point in time after elapse of a second period after time t47.

Moreover, the threshold correction operation is repeated in the period between time t49 and time t50 as well. Time t50 is the time at which the threshold correction operation ends, and write transistor T1 enters a non-conducting state at time t9. The period from time t45 to time t46, the period from time t47 to time t48, and the period from time t49 to time t50 are threshold correction periods.

In this way, in addition to the 1H period in which organic EL display device 101 performs the threshold correction operation along with the write operation and the mobility correction operation, organic EL display device 901 may perform the threshold correction operation multiple times divided across a plurality of horizontal periods ahead of the 1H period, that is to say, perform a "divided threshold correction operation".

With this divided threshold correction operation, even if the time allotted as a single horizontal period is short due to an increase in the number of pixels to achieve a higher definition, sufficient time can be ensured across a plurality of horizontal periods functioning as the threshold correction period. Accordingly, since a sufficient amount of time for a threshold correction period can be ensured even if the time allotted to a single horizontal period is short, it is possible to perform the threshold correction operation with certainty. Note that the number of times the threshold correction operation is performed is not limited to the above example; for example, the threshold correction operation may be performed only one time.

Write and Mobility Correction Period

Next, at time t51, in a state in which the potential of signal line 141 has switched from reference potential Vofs to signal voltage Vsig of the image signal, the potential of scan line 61 transitioning to the high potential side (i.e., from OFF to ON) places write transistor T1 in a conducting state, whereby signal voltage Vsig of the image signal is sampled and written in pixel circuit 120. Moreover, signal voltage Vsig is a voltage dependent on the gradation of the image signal, and is lower than reference potential Vofs.

The writing of signal voltage Vsig by write transistor T1 turns gate potential Vg of driver transistor T2*a* into signal voltage Vsig. At this time, first organic EL element EL1 is in a cut-off state. Accordingly, depending on signal voltage Vsig of the image signal, the current flowing through driver transistor T2*a* (drain-source current Ids) from power supply line 151 flows out of storage capacitor C1 and the equivalent capacitor of first organic EL element EL1. This starts the discharging of storage capacitor C1 and the equivalent capacitor. Note that in the period from time t51 to time t52, the current flowing through driver transistor T2*a* does not flow out from the equivalent capacitor of second organic EL element EL2. Accordingly, the current flowing through driver transistor T2*a* is used to discharge storage capacitor C1 and the equivalent capacitor of first organic EL element EL1. Stated differently, the equivalent capacitor of second organic EL element EL2 is not discharged by the current flowing through driver transistor T2*a*.

The discharging of the equivalent capacitor of first organic EL element EL1 causes source potential Vs of driver transistor T2*a* to decrease over time. At this time, variations in threshold voltage Vth of driver transistor T2*a* between pixel circuits 120 are already cancelled by the threshold correction operation, and drain-source current Ids of driver transistor T2*a* is dependent on mobility μ of driver transistor T2*a*. With this, reflecting mobility μ, the value of gate-source voltage Vgs of driver transistor T2*a* decreases, and after elapse of a given period of time, becomes a value that completely corrects mobility μ. Note that mobility μ of driver transistor T2*a* is the mobility of the semiconductor thin film that forms the channel of driver transistor T2*a*.

In the present variation, in the write period in which write transistor T1 conducts current in a state in which signal voltage Vsig is applied to signal line 141 (i.e., in the period from time t51 to time t52), second organic EL element EL2 is not connected to driver transistor T2*a*. Accordingly, in the write and mobility correction period, it is possible to reduce the equivalent capacitance of the organic EL element that is connected to driver transistor T2*a*, which makes it possible to reduce source potential Vs in a shorter amount of time. Stated differently, mobility correction can be sped up.

Emission Period

Next, at time t52, the potential of scan line 61 transitioning to the low potential side (i.e., from ON to OFF) places write transistor T1 in a non-conducting state, and the write operation ends. Consequently, gate electrode g of driver transistor T2*a* is in a floating state as a result of electrically disconnecting from signal line 141. The period from time t51 to time t52 is a write and mobility correction period.

The potential of control line 171 transitioning from the low potential side to the high potential side (i.e., from OFF to ON) at time t33 places switching transistor T3 in a conducting state. Switching transistor T3 turns ON after the signal write operation completes and write transistor T1 turns OFF. As a result of this operation, the second electrode of second organic EL element EL2 is connected to driver transistor T2*a* via switching transistor T3, source potential Vs of driver transistor T2*a* becomes a potential dependent on the equivalent capacitances of first organic EL element EL1 and second organic EL element EL2, current flows from the anode power supply line, source potential Vs of driver transistor T2*a* decreases in accordance with the current value, and both first organic EL element EL1 and second organic EL element EL2 emit light.

Note that it is sufficient if switching transistor T3 is OFF in at least the period in which mobility correction is performed. More specifically, it is sufficient if switching transistor T3 is OFF at least from time t51 to time t52. Moreover, when switching transistor T3 is turned off, switching transistor T3 is maintained in the OFF state until after the write operation (after time t52).

Here, when gate electrode g of driver transistor T2*a* is in a floating state, by storage capacitor C1 being connected between the gate and source of driver transistor T2*a*, gate potential Vg changes in conjunction with changes in source potential Vs of driver transistor T2*a*. In other words, source potential Vs and gate potential Vg of driver transistor T2*a* decreases while gate-source voltage Vgs stored in storage capacitor C1 is maintained. Source potential Vs of driver transistor T2*a* decreases to a light-emission voltage of first organic EL element EL1 and second organic EL element EL2 that is dependent on the drain-source current (saturation current) of driver transistor T2*a*.

Here, even when threshold voltages Vth of driver transistors T2*a* vary between pixel circuits 120, just like in the above embodiment, it is possible to reduce an uneven appearance of the display caused by the time difference between the points in time at which emission starts. In pixel circuit 120 including driver transistor T2*a* whose threshold voltage Vth is relatively low, at time t53, source potential Vs changes by amount of decrease Δv1. In pixel circuit 120 including driver transistor T2*a* whose threshold voltage Vth is relatively high, at time t53, source potential Vs of driver transistor T2*a* changes by amount of decrease Δv2. In the case of driver transistor T2*a* whose threshold voltage Vth is relatively high, since source potential Vs of such a driver transistor T2*a* is relatively low at time t53, amount of decrease Δvg is greater than amount of decrease Δv1.

As described above, by switching transistor T3 turning ON at time t53, source potential Vs of driver transistor T2*a* in pixel circuit 120 including driver transistor T2*a* whose threshold voltage Vth is relatively high decreases more so than source potential Vs of driver transistor T2*a* in pixel circuit 120 including driver transistor T2*a* whose threshold voltage Vth is relatively low. In other words, it possible to reduce the difference in emission start times resulting from the discrepancy in threshold voltages Vth of driver transistors T2*a*. Accordingly, since it is possible to reduce the time difference between emission start times of pixel circuits 120, it is possible to inhibit a difference in emission start times between pixel circuits 120 caused by discrepancies in threshold voltages Vth, which inhibits the manifestation of an uneven appearance of the display.

Other Embodiments

Hereinbefore, the pixel circuit and the organic EL display device according to the present disclosure have been described based on, but are not limited to, an embodiment and a variation thereof (hereinafter "embodiment, etc."). Embodiments resulting from arbitrary combinations of elements of the embodiment, etc., embodiments resulting from various modifications of the embodiment, etc., that may be conceived by those skilled in the art without materially departing from the novel teachings and advantages of the present disclosure, and various devices that include the pixel circuit and the organic EL display device according to the embodiment, etc., are intended to be included within the scope of the present disclosure.

General or specific aspects of the present disclosure may be realized as a system, method, integrated circuit, computer program, computer readable medium such as a CD-ROM, or any given combination thereof.

Moreover one aspect of the present disclosure may be implemented as a driving method for driving the pixel circuit and the organic EL display device described above. The pixel circuit includes a driver transistor configured to supply a current dependent on a voltage supplied via a signal line; a write transistor connected between the signal line and a gate electrode of the driver transistor; a first organic EL element connected to the driver transistor; a switching transistor connected to the driver transistor; and a second organic EL element connected to the driver transistor via the switching transistor. The pixel circuit is configured to perform mobility correction that corrects a mobility of the driver transistor. The driving method includes turning the switching transistor ON after a write operation that writes the voltage supplied via the signal line and turning the switching transistor OFF before an operation that performs the mobility correction of the driver transistor begins.

INDUSTRIAL APPLICABILITY

The present disclosure is applicable, for example, to pixel circuits that include an organic EL element.

The invention claimed is:

1. A pixel circuit, comprising:

a driver transistor configured to supply a current dependent on a voltage supplied via a signal line;

a write transistor connected between the signal line and a gate electrode of the driver transistor;

a first light emitting element directly connected to one electrode of the driver transistor, the one electrode being one of a drain electrode and a source electrode of the driver transistor;

a switching transistor connected to the one electrode of the driver transistor; and a second light emitting element connected to the one electrode of the driver transistor via the switching transistor, wherein the pixel circuit is configured so that the first light emitting element and the second light emitting element emit light in a same direction, wherein the pixel circuit is configured to perform mobility correction that corrects a mobility of the driver transistor, and the switching transistor is configured to turn ON after a write operation that writes the voltage supplied via the signal line and turn OFF before an operation that performs the mobility correction of the driver transistor begins.

2. The pixel circuit according to claim 1, further comprising:

a first subpixel circuit configured to emit light of a first color; and a second subpixel circuit configured to emit light of a second color different from the first color, wherein among the first subpixel circuit and the second subpixel circuit, only the first subpixel circuit includes the switching transistor and the second light emitting element.

3. The pixel circuit according to claim 2, wherein the pixel circuit further includes a third subpixel circuit configured to emit light of a third color different from the first color and the second color, among the first subpixel circuit, the second subpixel circuit, and the third subpixel circuit, only the first subpixel circuit includes the switching transistor and the second light emitting element, the first color is blue, the second color is red, and the third color is green.

4. The pixel circuit according to claim 3, wherein a capacitance of the first light emitting element included in the first subpixel circuit is equal to one of a capacitance of a light emitting element included in the second subpixel circuit and a capacitance of a light emitting element included in the third subpixel circuit.

5. The pixel circuit according to claim 1, wherein an operation that applies a negative bias to the first light emitting element before the operation that performs the mobility correction of the driver transistor is present in the pixel circuit, and the switching transistor is configured to turn OFF before the negative bias is applied to the first light emitting element.

6. The pixel circuit according to claim 1, wherein a surface area of the second light emitting element is larger than a surface area of the first light emitting element.

7. The pixel circuit according to claim 1, wherein the first light emitting element and the second light emitting element have a top-emission structure, the first light emitting element includes a first light emitter configured to emit light, and a first contact part configured to connect an anode of the first light emitting element and a thin film transistor (TFT) layer, the second light emitting element includes a second light emitter configured to emit light, and a second contact part configured to connect an anode of the second light emitting element and the TFT layer, and in a plan view of the pixel circuit, the first contact part and the second contact part are disposed between the first light emitter and the second light emitter.

8. The pixel circuit according to claim 1, wherein each of the first light emitting element and the second light emitting element is an organic electroluminescent (EL) element.

9. A display device, comprising:

the pixel circuit according to claim 1;

a horizontal selector configured to apply the voltage to the signal line;

a write scanner configured to control the write transistor;

a power supply scanner configured to apply a potential to the source electrode or the drain electrode of the driver transistor; and a switch scanner configured to control the switching transistor.

10. The pixel circuit according to claim 1, wherein the pixel circuit is configured to emit light from both the first light emitting element and the second light emitting element when the switching transistor is in an ON state and a positive voltage is applied to the drive transistor.

* * * * *